US009976381B2

(12) United States Patent
Martin et al.

(10) Patent No.: US 9,976,381 B2
(45) Date of Patent: May 22, 2018

(54) DOWNHOLE TOOL WITH AN EXPANDABLE SLEEVE

(71) Applicant: TEAM OIL TOOLS, LP, The Woodlands, TX (US)

(72) Inventors: Carl Martin, The Woodlands, TX (US); Justin Kellner, Adkins, TX (US); Stephen J. Chauffe, The Woodlands, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 0 days. days.

(21) Appl. No.: 15/727,390

(22) Filed: Oct. 6, 2017

(65) Prior Publication Data

US 2018/0030807 A1 Feb. 1, 2018

Related U.S. Application Data

(63) Continuation-in-part of application No. 15/217,090, filed on Jul. 22, 2016.

(Continued)

(51) Int. Cl.
*E21B 33/127* (2006.01)
*E21B 33/128* (2006.01)

(Continued)

(52) U.S. Cl.
CPC ..... *E21B 33/1277* (2013.01); *E21B 33/128* (2013.01); *E21B 33/129* (2013.01); *E21B 34/06* (2013.01); *E21B 2034/007* (2013.01)

(58) Field of Classification Search
CPC .. E21B 33/1277; E21B 33/128; E21B 33/129; E21B 33/12; E21B 33/1208;

(Continued)

(56) References Cited

U.S. PATENT DOCUMENTS 4,483,399 A 11/1984 Colgate
5,325,923 A 7/1994 Surjaatmadja et al.

(Continued)

FOREIGN PATENT DOCUMENTS

GB 2345308 A 7/2000
WO 2014/100072 A1 6/2014

(Continued)

OTHER PUBLICATIONS

Tae Wook Park (Authorized Officer), International Search Report and Written Opinion dated Nov. 4, 2016, PCT Application No. PCT/US2016/043545, filed Jul. 22, 2016, pp. 1-18.

(Continued)

*Primary Examiner* — Wei Wang
(74) *Attorney, Agent, or Firm* — MH2 Technology Law Group LLP

(57) ABSTRACT

A downhole tool, tool assembly, and method, of which the downhole tool includes an expandable sleeve defining a bore extending axially therethrough, and including a shoulder that extends inward from the bore, a first swage positioned at least partially within the bore and including a valve seat configured to receive an obstructing member, such that the obstructing member and the first swage substantially prevent fluid communication through the bore when the obstructing member is seated in the valve seat, a second swage positioned at least partially within the bore. The first and second swages are configured to deform the expandable sleeve radially outwards when the first and second swages are moved toward one another within the expandable sleeve, and the shoulder is configured to prevent at least one of the first and second swages from sliding therepast.

21 Claims, 21 Drawing Sheets

Related U.S. Application Data

(60) Provisional application No. 62/550,273, filed on Aug. 25, 2017, provisional application No. 62/196,712, filed on Jul. 24, 2015, provisional application No. 62/319,564, filed on Apr. 7, 2016.

(51) Int. Cl.
*E21B 33/129* (2006.01)
*E21B 34/06* (2006.01)
*E21B 34/00* (2006.01)

(58) Field of Classification Search
CPC ..... E21B 33/1204; E21B 33/1291; E21B 33/1292; E21B 33/1293; E21B 34/06; E21B 2034/007; E21B 33/134; E21B 33/13; E21B 43/103; E21B 43/261; E21B 23/01; E21B 23/06
See application file for complete search history.

(56) References Cited

U.S. PATENT DOCUMENTS 5,396,957 A 3/1995 Surjaatmadja et al.
6,354,373 B1 3/2002 Vercaemer et al.
6,446,323 B1 9/2002 Metcalfe et al.
6,662,876 B2 12/2003 Lauritzen
6,702,029 B2 3/2004 Metcalfe et al.
6,722,437 B2 4/2004 Vercaemer et al.
7,093,656 B2 8/2006 Maguire
7,104,322 B2 9/2006 Whanger et al.
7,168,499 B2 1/2007 Cook et al.
7,172,025 B2 2/2007 Eckerlin
7,273,110 B2 9/2007 Pedersen et al.
7,350,588 B2 4/2008 Abercrombie et al.
7,367,391 B1 5/2008 Stuart et al.
7,422,060 B2 9/2008 Hammami et al.
7,475,736 B2 1/2009 Lehr et al.
7,520,335 B2 4/2009 Richard et al.
7,527,095 B2 5/2009 Bloess et al.
7,552,766 B2 6/2009 Gazewood
7,584,790 B2 9/2009 Johnson
7,607,476 B2 10/2009 Tom et al.
7,757,758 B2 7/2010 O'Malley et al.
7,814,978 B2 10/2010 Steele et al.
7,832,477 B2 11/2010 Cavender et al.
7,861,774 B2 1/2011 Fehr et al.
7,921,925 B2 4/2011 Maguire et al.
8,016,032 B2 9/2011 Mandrell et al.
8,267,177 B1 9/2012 Vogel et al.
8,291,982 B2 10/2012 Murray et al.
8,336,616 B1 12/2012 McClinton
8,397,820 B2 3/2013 Fehr et al.
8,459,347 B2 6/2013 Stout
8,573,295 B2 11/2013 Johnson et al.
8,579,024 B2 * 11/2013 Mailand ..... E21B 33/134 166/118
8,684,096 B2 4/2014 Harris et al.
8,905,149 B2 12/2014 Bailey et al.
9,010,416 B2 4/2015 Xu et al.
9,033,060 B2 5/2015 Xu et al.
9,057,260 B2 6/2015 Kelbie et al.
9,206,659 B2 12/2015 Zhang et al.
9,752,423 B2 9/2017 Lynk
2003/0062171 A1 4/2003 Maguire et al.
2004/0060700 A1 4/2004 Vert et al.
2004/0069485 A1 4/2004 Ringgengberg et al.
2005/0211446 A1 9/2005 Ricalton et al.
2005/0217866 A1 10/2005 Watson et al.
2006/0185855 A1 8/2006 Jordan et al.
2007/0000664 A1 1/2007 Ring et al.
2008/0073074 A1 3/2008 Frazier
2008/0135248 A1 6/2008 Talley et al.
2009/0065196 A1 3/2009 Holland et al.
2009/0242213 A1 10/2009 Braddick
2010/0032167 A1 2/2010 Adam et al.
2010/0116489 A1 5/2010 Nelson
2010/0319427 A1 12/2010 Lohbeck
2010/0319927 A1 12/2010 Yokley et al.
2011/0005779 A1 1/2011 Lembcke
2011/0132623 A1 6/2011 Moeller
2011/0240295 A1 10/2011 Porter et al.
2011/0284232 A1 11/2011 Huang
2012/0067583 A1 3/2012 Zimmerman et al.
2012/0111566 A1 5/2012 Sherman et al.
2012/0199341 A1 8/2012 Kellner et al.
2012/0247767 A1 10/2012 Themig et al.
2012/0273199 A1 11/2012 Cresswell et al.
2013/0062063 A1 3/2013 Baihly et al.
2013/0186615 A1 7/2013 Hallubaek et al.
2015/0068757 A1 3/2015 Hofman et al.
2015/0184485 A1 7/2015 Xu et al.
2016/0160591 A1 * 6/2016 Xu ..... E21B 23/01 166/382
2016/0186511 A1 6/2016 Coronado et al.
2016/0305215 A1 10/2016 Harris et al.
2016/0312557 A1 10/2016 Kitzman
2017/0101843 A1 4/2017 Waterhouse et al.

FOREIGN PATENT DOCUMENTS

WO 2016/160003 A1 10/2016
WO 2017/151384 A1 9/2017

OTHER PUBLICATIONS

Hinkie et al., "Multizone Completion with Accurately Placed Stimulation Through Casing Wall", SPE Production and Operations Symposium, Mar. 31-Apr. 3, 2007, pp. 1-4.
Anjum et al., "Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way", SPE International Oil & Gas Conference, Jun. 8-10, 2010, pp. 1-16.
Vargus et al., "Completion System Allows for Interventionless Stimulation Treatments in Horizontal Wells with Multiple Shale Pay Zones", SPE Annual Technical Conference, Sep. 2008, pp. 1-8.
Gorra, et al., "Expandable Zonal Isolation Barrier (ZIB) Provides a Long-Term Well Solution as a High Differential Pressure Metal Barrier to Flow", Brazilian Petroleum Technical Papers, 2010, Abstract only, 1 page.
Vargus, et al., "System Enables Multizone Completions", The American Oil & Gas Reporter, 2009, Abstract only, 1 page.
Vargus, et al., "Completion System Allows for Interventionless Stimulation Treatments in Horizontal Wells with Multiple Shale Pay Zones", Annual SPE Technical Conference, Sep. 2008, Abstract only, 1 page.

* cited by examiner

DOWNHOLE TOOL WITH AN EXPANDABLE SLEEVE

CROSS-REFERENCE TO RELATED APPLICATIONS

This application claims priority to U.S. Provisional Patent Application having Ser. No. 62/550,273, which was filed on Aug. 25, 2017. This application is also a continuation-in-part of U.S. patent application having Ser. No. 15/217,090, which was filed on Jul. 22, 2016 and claims priority to U.S. Provisional Patent Application having Ser. No. 62/196,712, filed on Jul. 24, 2015, and U.S. Provisional Patent Application having Ser. No. 62/319,564, filed on Apr. 7, 2016. Each of these priority applications is incorporated herein by reference.

BACKGROUND

There are various methods by which openings are created in a production liner for injecting fluid into a formation. In a "plug and perf" frac job, the production liner is made up from standard lengths of casing. Initially, the liner does not have any openings through its sidewalls. The liner is installed in the wellbore, either in an open bore using packers or by cementing the liner in place, and the liner walls are then perforated. The perforations are typically created by perforation guns that discharge shaped charges through the liner and, if present, adjacent cement.

The production liner is typically perforated first in a zone near the bottom of the well. Fluids then are pumped into the well to fracture the formation in the vicinity of the perforations. After the initial zone is fractured, a plug is installed in the liner at a position above the fractured zone to isolate the lower portion of the liner. The liner is then perforated above the plug in a second zone, and the second zone is fractured. This process is repeated until all zones in the well are fractured.

The plug and perf method is widely practiced, but it has a number of drawbacks, including that it can be extremely time consuming. The perforation guns and plugs are generally run into the welt and operated individually. After the frac job is complete, the plugs are removed (e.g., drilled out) to allow production of hydrocarbons through the liner,

SUMMARY

Embodiments of the disclosure may provide a downhole tool that includes an expandable sleeve defining a bore extending axially therethrough, and including a shoulder that extends inward from the bore. The tool also includes a first swage positioned at least partially within the bore and comprising a valve seat configured to receive an obstructing member, such that the obstructing member and the first swage substantially prevent fluid communication through the bore when the obstructing member is seated in the valve seat, and a second swage positioned at least partially within the bore. The first and second swages are configured to deform the expandable sleeve radially outwards when the first and second swages are moved toward one another within the expandable sleeve, and the shoulder is configured to prevent at least one of the first and second swages from sliding therepast.

Embodiments of the disclosure may also provide a tool assembly including a downhole tool that includes an expandable sleeve defining a bore therethrough, the bore including a first portion and a second portion. The expandable sleeve includes a shoulder that extends inwardly from the first and second portions. The downhole tool also includes a first swage positioned at least partially within the first portion of the bore and including a valve seat configured to receive an obstructing member, such that the obstructing member and the first swage substantially prevent fluid communication through the bore when the obstructing member is seated in the valve seat. The downhole tool also includes a second swage positioned at least partially within the second portion of the bore. The tool assembly further includes a setting tool including an outer body configured to engage the first swage and apply a force on the first swage directed toward the shoulder, and an inner body extending through the first swage, the expandable sleeve, and the second swage, the inner body being coupled to the second swage and configure to apply a force on the second swage directed toward the shoulder. The first and second swages are configured such that moving the first and second swages toward the shoulder deforms the expandable sleeve radially outwards, and the shoulder is configured to prevent the first swage from being forced therepast.

Embodiments of the disclosure may further provide a method for plugging an oilfield tubular in a well. The method includes positioning a downhole tool in the oilfield tubular, the downhole tool comprising an expandable sleeve, a first swage positioned at least partially in the expandable sleeve, and a second swage positioned at least partially in the expandable sleeve. The method also includes forcing the first and second swages toward one another within the expandable sleeve, to expand the expandable sleeve into engagement with the oilfield tubular. The expandable sleeve includes a bore against which the first and second swages slide, and a shoulder that extends inwardly from the bore. The shoulder defines an end face configured to engage the first swage and prevent at least the first swage from sliding therepast. The method further includes deploying an obstructing member into the tubular. The first swage includes a valve seat that is configured to catch the obstructing member. The expandable sleeve, the first swage, and the obstructing member are configured to block the oilfield tubular when the expandable sleeve is expanded and the obstructing member is seated in the valve seat.

The foregoing summary is intended merely to introduce some aspects of the following disclosure and is thus not intended to be exhaustive, identify key features, or in any way limit the disclosure or the appended claims.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
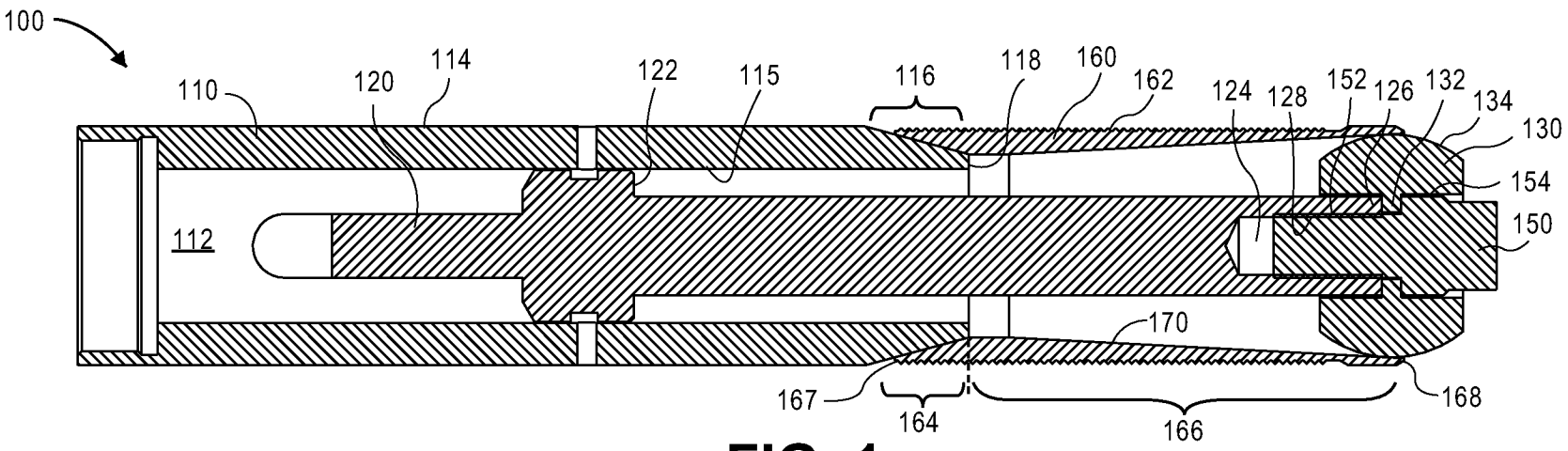
FIG. 1 illustrates a cross-sectional side view of a downhole tool in a first, run-in configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional side view of a downhole tool 100 in a run-in configuration, according to an embodiment. The downhole tool 100 may include a setting tool having a setting sleeve 110 and an inner body 120. The downhole tool 100 may also include a first body 130 and an expandable sleeve 160. In this embodiment, the setting sleeve 110 may also be referred to as a "second body" of the downhole tool 100. The first body 130 and the second body (the setting sleeve 110) may cooperate to expand (swage) the expandable sleeve 160 in a radial direction. Such expansion will be explained in greater detail below, according to an embodiment.

The setting sleeve 110 may be substantially cylindrical and may have a bore 112 formed axially-therethrough. An outer surface 114 of the setting sleeve 110 may include a tapered portion 116 proximate to (e.g., extending from) a lower axial end 118 of the setting sleeve 110. More particularly, a thickness of the tapered portion 116 may decrease proceeding toward the lower axial end 118.

The inner body 120 may be positioned within the bore 112 of the setting sleeve 110 and may be movable with respect thereto. The inner body 120 may include an outer shoulder 122 that contacts an inner surface 115 of the setting sleeve 110, so as to guide the movement of the inner body 120. The inner body 120 may also define an axial bore 124 formed at least partially therethrough, proximate to a lower axial end 126 of the inner body 120. An inner surface 128 of the inner body 120 that defines the bore 124 may be threaded.

The first body 130 may be coupled to the inner body 120 proximate to the lower axial end 126 of the inner body 120. The first body 130 may have a bore formed axially-therethrough, in which the inner body 120 of the setting tool may be at least partially received. An inner surface of the first body 130 that defines the bore may include a protrusion (e.g., an annular protrusion) 132 that extends radially-inward therefrom. The protrusion 132 may be integral with the first body 130, or the protrusion 132 may be part of a separate component that is coupled to, or positioned within a recess in, the first body 130. The inner body 120 may abut against the protrusion 132.

The first body 130 may be at least partially tapered. For example, the first body 130 may expand in radial dimension (e.g., in a direction perpendicular to an axial direction parallel to a central longitudinal axis through the tool 100) from the upper axial end to an axially intermediate point, and then reduce to a lower axial end. In other embodiments, the first body 130 may have a section that increases in radial dimension, but may omit the section of decreasing radial dimension. Consistent with such tapered geometry, the first body 130 may be formed as a truncated cone, a truncated sphere, another shape, or a combination thereof.

A locking mechanism 150 may be coupled to the inner body 120 and/or the first body 130. The locking mechanism may be, for example, a bolt or screw, and may include a shank 152 and a head 154. The shank 152 may be received through the bore of the first body 130 and at least partially into the bore 124 of the inner body 120, e.g., threaded thereto, such that the protrusion 132 of the first body 130 is positioned between the lower axial end 126 of the inner body 120 and the head 154 of the locking mechanism 150. In other embodiments, the shank 152 may be otherwise attached to the inner body 120, e.g., the shank 152 may be pinned, adhered, soldered, welded, brazed, etc., to the inner body 120.

The expandable sleeve 160 may be positioned at least partially axially between the tapered portion 116 of the setting sleeve 110 and the first body 130. The expandable sleeve 160 may be positioned radially-outward from the tapered portion 116 of the setting sleeve 110, the inner body 120, the first body 130, or a combination thereof. An outer surface 162 of the expandable sleeve 160 may be configured to set in a surrounding tubular member (e.g., a liner, a casing, a wall of a wellbore, etc.).

In some embodiments, to set the expandable sleeve 160, the outer surface 162 may form a high-friction interface with the surrounding tubular, e.g., with sufficient friction to avoid axial displacement of the expandable sleeve 160 with respect to the surrounding tubular, once set therein. In an embodiment, the outer surface 162 may be applied with, impregnated with, or otherwise include grit. For example, such grit may be provided by a carbide material. Illustrative materials on the outer surface 162 of the expandable sleeve 160 may be found in U.S. Pat. No. 8,579,024, which is incorporated by reference herein in its entirety to the extent not inconsistent with the present disclosure. In some embodiments, the grit may be provided as a thermal-spray metal, such as WEARSOX®, for example, as disclosed in U.S. Pat. No. 7,487,840, and/or U.S. Patent Publication No. 2015/0060050, which are both incorporated herein by reference to the extent not inconsistent with the present disclosure. In other embodiments, the outer surface 162 may include teeth, (e.g., wickers, buttons, etc.) designed to bite into (e.g., partially embed in) another material.

The expandable sleeve 160 may include a first, upper axial portion 164 and a second, lower axial portion 166. One or both of the first and second axial portions 164, 166 may be tapered, such that the thickness thereof varies along the axial length thereof. For example, the inner diameter of the expandable sleeve 160 may decrease in the first axial portion 164, as proceeding toward a lower axial end 168 of the expandable sleeve 160, while the outer diameter may remain generally constant. Similarly, the inner diameter of the expandable sleeve 160 in the second axial portion 166 may increase as proceeding toward the lower axial end 168, while the outer diameter remains generally constant. Accordingly, in some embodiments, an inner surface 170 of the expandable sleeve 160 may be oriented at an angle with respect to a central longitudinal axis through the downhole tool 100. For example, the inner surface 170 may be oriented at a first angle in the first axial portion 164 and a second angle in the second axial portion 166. Both angles may be acute, for example, from about 5° to about 20°, about 10° to about 30°, or about 15° to about 40°.

The first body 130 may be positioned at least partially, radially between the expandable sleeve 160 (on one side) and the inner body 120 and/or the locking mechanism 150 (on the other side). For example, an outer surface 134 of the first body 130 may be configured to slide against the inner surface 170 of the expandable sleeve 160. The outer surface 134 of the first body 130 and/or the inner surface 170 of the expandable sleeve 160 may be provided with a high-friction coating, such as a grit. Alternatively or additionally, the outer surface 134 and/or the inner surface 170 may be provided with teeth or a ratcheting mechanism. The function of such coating, teeth, and/or ratcheting mechanism is to maintain the position of the first body 130 relative to the expandable sleeve 160, so as to resist the first body 130 being pushed out of the bore of the expandable sleeve 170 when in the expanded configuration, as will be explained in greater detail below.

In addition, the first body 130 may be positioned proximate to the lower axial end 168 of the expandable sleeve 160, e.g., at least partially within the expandable sleeve 160, when the downhole tool 100 is in the first, run-in configuration. The first body 130 may be configured to remain in the expandable sleeve 160 after the setting tool is removed, as will be described in greater detail below.

Figure 2:
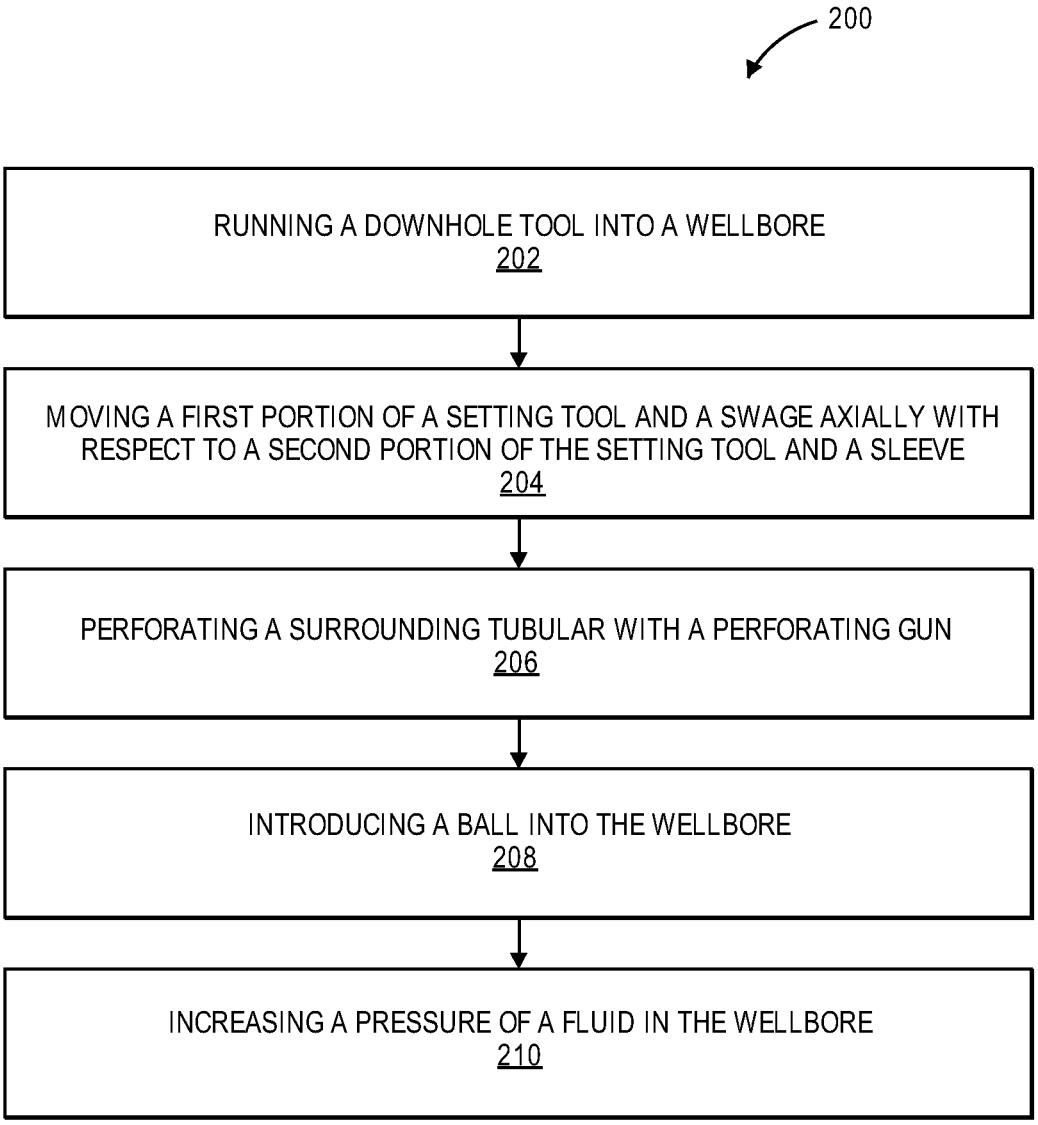
FIG. 2 illustrates a flowchart of a method for actuating the downhole tool, according to an embodiment.

FIG. 2 illustrates a flowchart of a method 200 for actuating the downhole tool 100, according to an embodiment. The method 200 may be viewed together with FIGS. 1 and 3-6, which illustrate the various configurations of the downhole tool 100 during operation of the method 200.

The method 200 includes running a downhole tool (e.g., the downhole tool 100) into a wellbore in a first, run-in configuration, as at 202, and as shown in and described above with respect to FIG. 1. The method 200 may also include moving a first portion of a setting tool and a swage axially with respect to a second portion of the setting tool and a sleeve, as at 204. For example, the inner body 120 of the setting tool and the first body 130 (providing the swage) may be moved axially with respect to the setting sleeve 110 of the setting tool and the expandable sleeve 160. More particularly, the inner body 120 may be pulled uphole (to the left in the Figures), while the setting sleeve 110 may be pushed downhole (to the right in the Figures). This may cause the inner body 120, and thus the first body 130, to be moved in the uphole direction with respect to the setting sleeve 110, and thus the expandable sleeve 160. In another embodiment, the setting sleeve 110 and the expandable sleeve 160 may be moved in a downhole direction with respect to the inner body 120 and the first body 130. In either example, the first body 130 slides along the tapered inner surface 170 of the sleeve and drives the expandable sleeve 160 radially-outward (e.g., swages the expandable sleeve 160) along the way. Accordingly, the expandable sleeve 160 is expanded radially-outward into a "set" position, e.g., engaging the surrounding structure.

Figure 3:
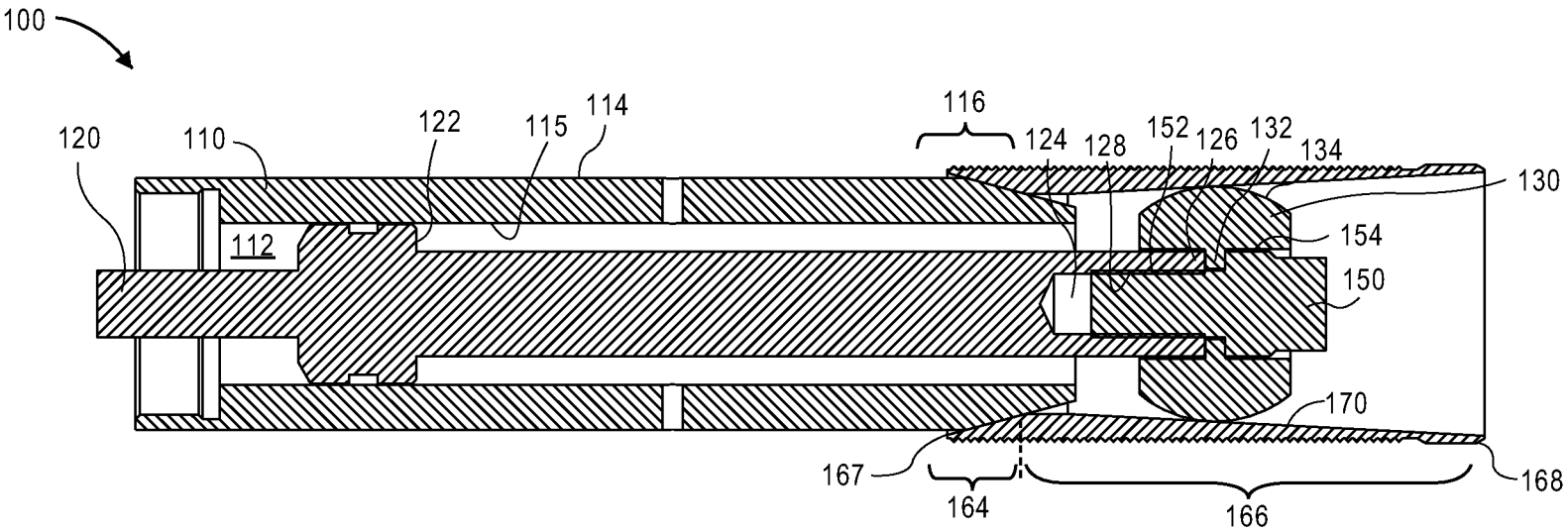
FIG. 3 illustrates a cross-sectional side view of the downhole tool of FIG. 1 after a sleeve has been set, according to an embodiment.

FIG. 3 illustrates a cross-sectional side view of the downhole tool 100 after the expandable sleeve 160 has been set, according to an embodiment. As shown, the inner body 120, the first body 130, and the locking mechanism 150 have been moved together in the uphole direction relative to the setting sleeve 110. As the first body 130 moves axially-uphole with respect to the expandable sleeve 160, the upper axial portion 164 of the expandable sleeve 160 may slide up the tapered portion 116 of the setting sleeve 110. In addition, the contact between the first body 130 and the inner surface 170 of the lower axial portion 166 of the expandable sleeve 160 may push the expandable sleeve 160 radially-outward due to the decreasing inner diameter of the lower axial portion 166 of the expandable sleeve 160.

The force required to pull the inner body 120, the first body 130, and the locking mechanism 150 in the uphole direction (or to maintain the position thereof while the setting sleeve 110 pushes the expandable sleeve 160 downwards) may increase as the first body 130 moves in the uphole direction due to the decreasing diameter of the inner surface 170 of the lower axial portion 166 of the expandable sleeve 160 (proceeding in the uphole direction). When the force reaches or exceeds a predetermined amount, a portion of the downhole tool 100, e.g., the protrusion 132, may shear, thereby releasing the inner body 120 from the first body 130.

Figure 4:
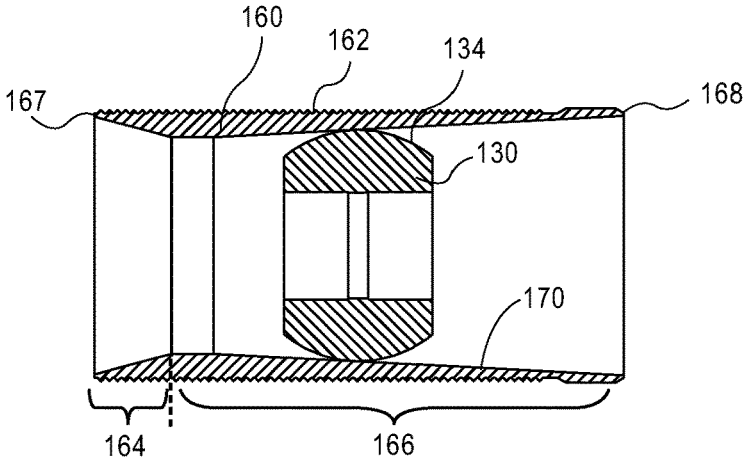
FIG. 4 illustrates a cross-sectional side view of a portion of the downhole tool of FIG. 1 after a setting tool is removed, leaving a swage within the sleeve, according to an embodiment.

FIG. 4 illustrates a cross-sectional side view of a portion of the downhole tool 100 after the setting sleeve 110 and the inner body 120 are removed, according to an embodiment. This may be referred to as the "set configuration" of the downhole tool 100. As shown, when the force exceeds the predetermined amount, the protrusion 132 of the first body 130 may shear, allowing the inner body 120 and the locking mechanism 150 to be pulled back to the surface, while the first body 130 remains positioned within the expandable sleeve 160. Interference (e.g., hoop stress) between the first body 130 and the expandable sleeve 160 may produce a secure connection therebetween, while the first body 130 continues to exert a radially outward force on the expandable sleeve 160, keeping the expandable sleeve 160 linearly coupled or "set" within the surrounding tubular (e.g., casing or wellbore).

In another embodiment, rather than the protrusion 132 shearing, the threaded engagement between the inner body 120 and the locking mechanism 150 may shear, allowing the inner body 120 to be pulled back to the surface, while the first body 130 remains positioned within the expandable sleeve 160. In this embodiment, the locking mechanism 150 may fall into the sump of the wellbore. In yet another embodiment, the inner body 120 may be coupled (e.g., threaded) to the inner surface of the first body 130, and the locking mechanism 150 may be omitted. In this embodiment, the threaded engagement between the inner body 120 and the first body 130 may shear, allowing the inner body 120 to be pulled back to the surface, while the first body 130 remains positioned within the expandable sleeve 160. In other embodiments, the inner body 120 and/or the locking mechanism 150 may yield, allowing the inner body 120 to be retrieved from the wellbore.

The method 200 may also include perforating a surrounding tubular with a perforating gun, as at 206. The surrounding tubular may be the tubular that the expandable sleeve 160 engages and bites into. In at least one embodiment, the surrounding tubular may be perforated after the expandable sleeve 160 expands and contacts the surrounding tubular.

Figure 5:
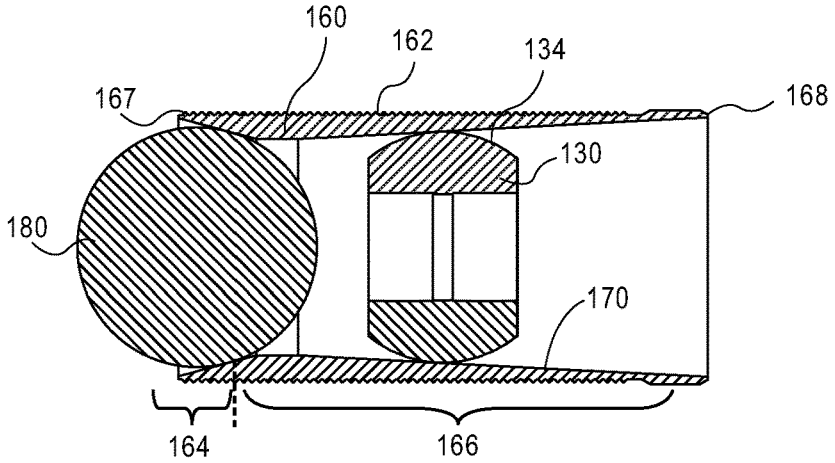
FIGS. 5 and 6 illustrate a cross-sectional side view and a cross-sectional perspective view, respectively, of a portion of the downhole tool of FIG. 1 after a ball is received in the sleeve, according to an embodiment.
Figure 6:
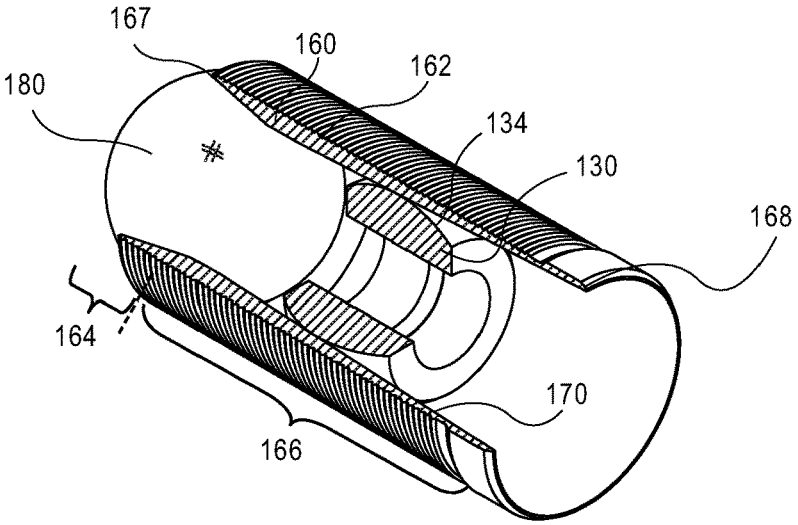

The method 200 may also include introducing an isolation device 180, such as a ball into the wellbore, where the isolation device 180 is received in the expandable sleeve 160, as at 208. The isolation device 180 may have any suitable shape (spherical or not) employed to be caught by a seat so as to obstruct fluid communication in a wellbore. FIGS. 5 and 6 illustrate a cross-sectional side view and a cross-sectional perspective view, respectively, of a portion of the downhole tool 100 (e.g., the first body 130 and the expandable sleeve 160) after the isolation device 180 is received in the expandable sleeve 160, according to an embodiment. As shown, the isolation device 180 may be received in the inner surface 170 of the upper axial portion 164 of the expandable sleeve 160, which may provide the ball seat. The seat may thus be proximal to the first body 130. Furthermore, the isolation device 180 may be sized to further expand at least a portion of the expandable sleeve 160, by transferring a pressure in the wellbore into a radial force by the wedge-shape of the seat, and thereby forcing the expandable sleeve 160 outward, further engaging the surrounding tubular, in at least some embodiments. In another embodiment, the isolation device 180 may be received by the first body 130, which may provide the seat. The isolation device 180 may plug the wellbore, isolating the portion of the wellbore above the expandable sleeve 160 and the isolation device 180 from the portion of the wellbore below the expandable sleeve 160 and the isolation device 180. In at least one embodiment, the isolation device 180 may be introduced into the wellbore after the surrounding tubular is perforated.

The method 200 may also include increasing a pressure of a fluid in the wellbore, as at 210. The isolation provided by the expandable sleeve 160 and the isolation device 180 may allow the pressure uphole of the expandable sleeve 160 and isolation device 180 to be increased (e.g., using a pump at the surface), while the wellbore below the expandable sleeve 160 and the isolation device 180 may be isolated from such pressure increase. The increased pressure may cause the subterranean formation around the wellbore, above the expandable sleeve 160 and isolation device 180, to fracture. This may take place after perforation occurs.

In at least one embodiment, the first body 130, the expandable sleeve 160, and/or the isolation device 180 may be made of a material that dissolves after a predetermined amount of time in contact with a liquid in the wellbore. The predetermined amount of time may be from about 6 hours to about 12 hours, from about 12 hours to about 24 hours, from about 1 day to about 2 days, from about 2 days to about 1 week, or more. In one specific embodiment, the isolation device 180 may be made of a material the dissolves after the predetermined amount of time, and the first body 130 and the expandable sleeve 160 may be made of a metal, such as aluminum, that does not dissolve after the predetermined amount of time. In some embodiments, the expandable sleeve 160 may be made at least partially from a metal (e.g., aluminum or an alloy thereof), while the first body 130 and/or the isolation device 180 may be made at least partially from a dissolvable material (e.g., a material that includes magnesium), such that the sleeve 160 may remain substantially intact after the dissolvable material is dissolved. In some embodiments, the expandable sleeve 160 may be made from a dissolvable material (e.g., a material that includes magnesium). Further, in some embodiments, all or a portion of a surface of any dissolvable component may include grooves, or other structures configured to increase a surface area of the surface, so as to increase the rate of dissolution.

Figure 7:
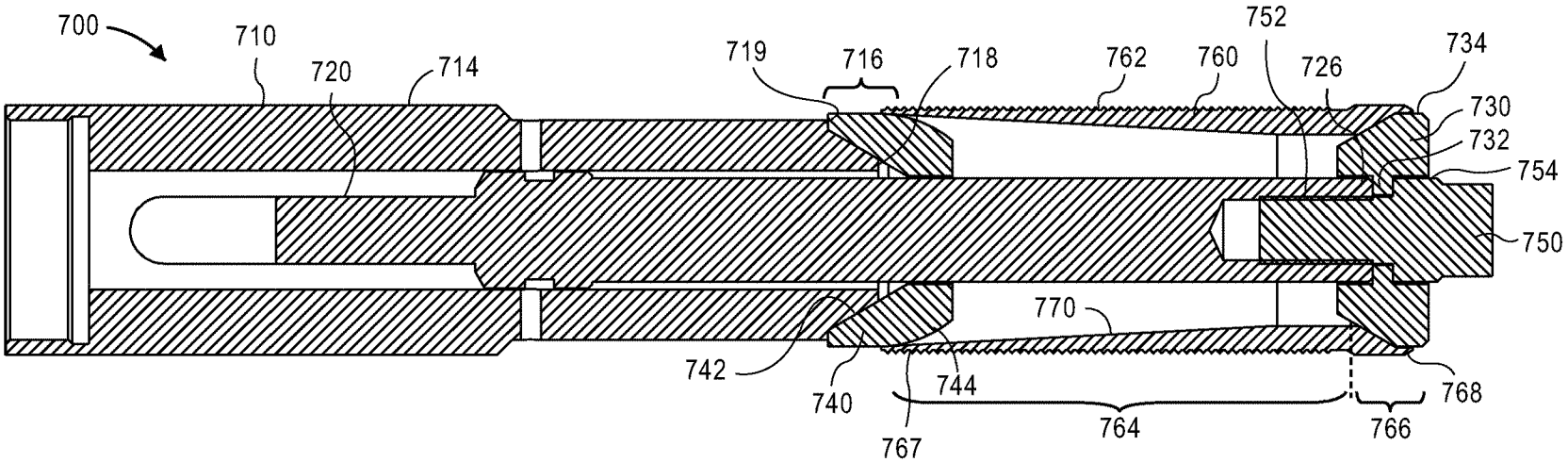
FIG. 7 illustrates a cross-sectional side view of another downhole tool in a first, run-in configuration, according to an embodiment.

FIG. 7 illustrates a cross-sectional side view of another downhole tool 700 in a run-in configuration, according to an embodiment. The downhole tool 700 may include a setting tool having a setting sleeve 710 and an inner body 720, with the setting sleeve 710 being disposed around the inner body 720. The downhole tool 700 may further include a first body 740, a second body 730, and a generally cylindrical, expandable sleeve 760. In at least one embodiment, the second body 730 and the expandable sleeve 760 may be integrally formed. The first body 740 may be a swage, which may cause the expandable sleeve 760 to expand radially outwards as the first body 740 is moved through the expandable sleeve 760. The second body 730 may be a stop or plug that may hold the expandable sleeve 760 in place relative to the first body 740 as the first body 740 is moved (and/or may be employed to move the expandable sleeve 760 relative to the first body 740), as will be described in greater detail below.

For example, the first body 740 may be positioned near an upper axial end 767 of the expandable sleeve 760 and adjacent to the setting sleeve 710 when the downhole tool 700 is in the first, run-in position. The setting sleeve 710 may thus be configured to engage and bear upon the first body 740, e.g., in a downhole direction, toward the expandable sleeve 760.

Optionally, an outer surface 714 of the setting sleeve 710 may include the tapered portion 716 proximate to the lower axial end 718 thereof. More particularly, a thickness of the tapered portion 716 may decrease proceeding toward the lower axial end 718. An inner surface 742 of the first body 740 may also be tapered, such that engagement between the setting sleeve 710 and the first body 740 is effected through the tapered interface therebetween. As a further option, the outer surface 714 of the setting sleeve 710 may also include a shoulder 719 that extends radially-outward from the tapered portion 716, and the inner surface 742 of the first body 740 may include a shoulder to engage the shoulder 719. In other embodiments, however, the interface between the first body 740 and the setting sleeve 710 may be generally perpendicular to the central longitudinal axis of the tool 700 (e.g., straight radial), and such tapered surfaces may be substituted with flat surfaces.

The first body 740 may be received at least partially within the upper axial end 767 the expandable sleeve 760. As such, the first body 740 may be positioned at least partially, radially between the inner body 720 and the expandable sleeve 760. Further, at least a portion of the first body 740 may be tapered (e.g., curved or conical, as described above) such that the diameter of an outer surface 744 of the first body 740 decreases proceeding toward the lower axial end of the first body 740.

The second body 730 may be positioned at least partially within a lower axial end 768 of the expandable sleeve 760, opposite to the first body 740. The second body 730 may have a bore formed axially-therethrough, in which the inner body 720 may be at least partially received. An inner surface of the second body 730 that defines the bore may include a protrusion (e.g., an annular protrusion) 732 that extends radially-inward therefrom. The protrusion 732 may be integral with the second body 730 or part of a separate component that is coupled to, or positioned within a recess in, the second body 730. The second body 730 may be tapered such that a diameter of an outer surface 734 of the second body 730 increases proceeding toward a lower axial end of the second body 730.

The tool 700 may also include a locking mechanism 750, which may be or include a screw or both, and may thus include a head 754 and a shank 752. In some embodiments, the shank 752 may be threaded. Further, the shank 752 may be sized to engage threads within a bore formed in the lower axial end 726 of the inner body 720, or otherwise form an engagement with the inner body 720.

The protrusion 732 of the second body 730 may be positioned axially-between the lower axial end 726 of the inner body 720 and the head 754 of the locking mechanism 750. When the inner body 720 is engaged with the locking mechanism 750, the second body 730 may be secured in place between the inner body 720 and the head 754 of the locking mechanism 750.

The expandable sleeve 760 may be positioned at least partially, axially-between the second body 730 and the first body 740. Further, the expandable sleeve 760 may be positioned radially-outward from the inner body 720, the second body 730, the first body 740, or a combination thereof. The outer surface of the first body 740 and/or the inner surface 770 of the expandable sleeve 760 may be provided with a high-friction coating, such as a grit. In some embodiments, the grit may be provided as a thermal-spray metal, such as WEARSOX®, for example, as disclosed in U.S. Pat. No. 7,487,840, and/or U.S. Patent Publication No. 2015/0060050, incorporated by reference above. Alternatively or additionally, the outer surface of the second body 740 and/or the inner surface 770 may be provided with such grit, teeth, buttons, and/or a ratcheting mechanism. The function of such coating, grit, teeth, buttons, and/or ratcheting mechanism is to maintain the position of the second body 740 relative to the expandable sleeve 760, so as to resist the second body 740 being pushed out of the bore of the expandable sleeve 760 when in the expanded configuration, as will be explained in greater detail below.

The upper axial portion 764 of the expandable sleeve 760 may be tapered such that a thickness of the upper axial portion 764 of the expandable sleeve 760 decreases proceeding toward the upper axial end 767 of the expandable sleeve 760. A lower axial portion 766 may be reverse tapered in comparison to the upper axial portion 764, such that the radial thickness of the expandable sleeve 760 decreases as proceeding toward the lower axial end 768 thereof.

In some embodiments, one or more of the first body 730, the second body 740, the expandable sleeve 760, and/or the isolation device 780 or 782 may be dissolvable after a predetermined amount of time within the wellbore. For example, such component(s) may be made at least partially from magnesium. In some embodiments, the expandable sleeve 760 may be made from a material that does not dissolve in a certain fluid, while the first body 730, the second body 740, the isolation devices 780 or 782, or any combination thereof, is made from a material that dissolves in the fluid, such that the expandable sleeve 760 may remain intact after the dissolvable material is dissolved. Further, in some embodiments, all or a portion of a surface of any dissolvable component may include grooves, or other structures configured to increase a surface area of the surface, so as to increase the rate of dissolution.

Figure 8:
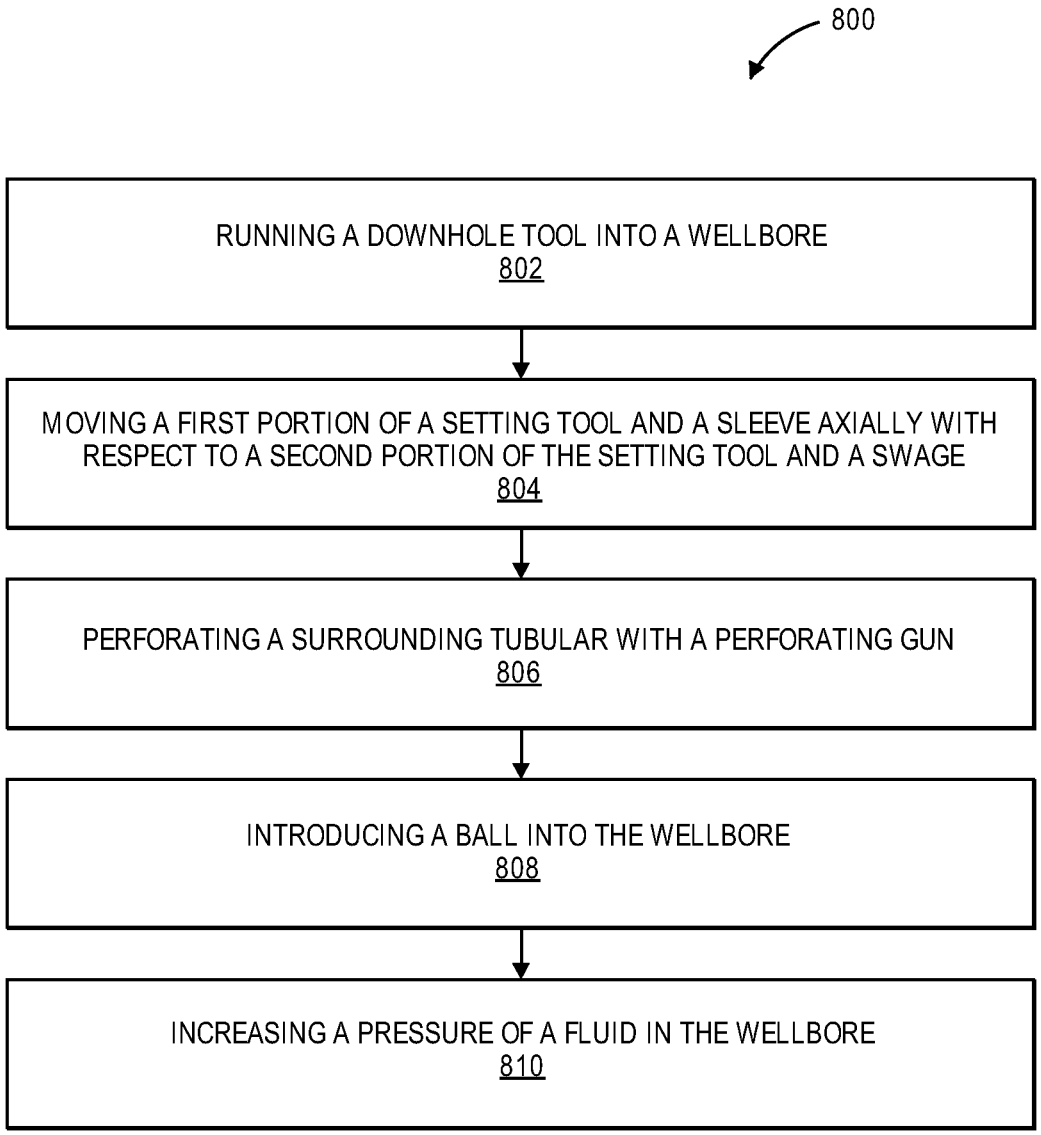
FIG. 8 illustrates a flowchart of another method for actuating the downhole tool of FIG. 8, according to an embodiment.

FIG. 8 illustrates a flowchart of a method 800 for actuating a downhole tool, according to an embodiment. The method 800 is described herein with reference to the downhole tool 700 and may thus be understood with reference to FIGS. 7 and 9-12. The method 800 may begin by running a downhole tool (e.g., the downhole tool 700) into a wellbore in a first, run-in configuration, as at 802.

The method 800 may also include moving a first portion of a setting tool and an expandable sleeve axially with respect to a second portion of the setting tool and a swage, as at 804. For example, the inner body 720 may be pulled uphole, while the setting sleeve 710 may be pushed downhole. In turn, the inner body 720 may pull the second body 730, and thus the expandable sleeve 760 uphole, while the setting sleeve 710 may prevent movement of the first body 740, or may even push the first body 740 downhole. This may cause the expandable sleeve 760 to move over the first body 740, which may result in at least a portion of the expandable sleeve 760 being expanded radially-outward by the first body 740 as the first body 740 slides across the tapered inner surface 770. Accordingly, the expandable sleeve 760 may be actuated into a set position, e.g., in which the expandable sleeve 760 engages a surrounding tubular.

Figure 9:
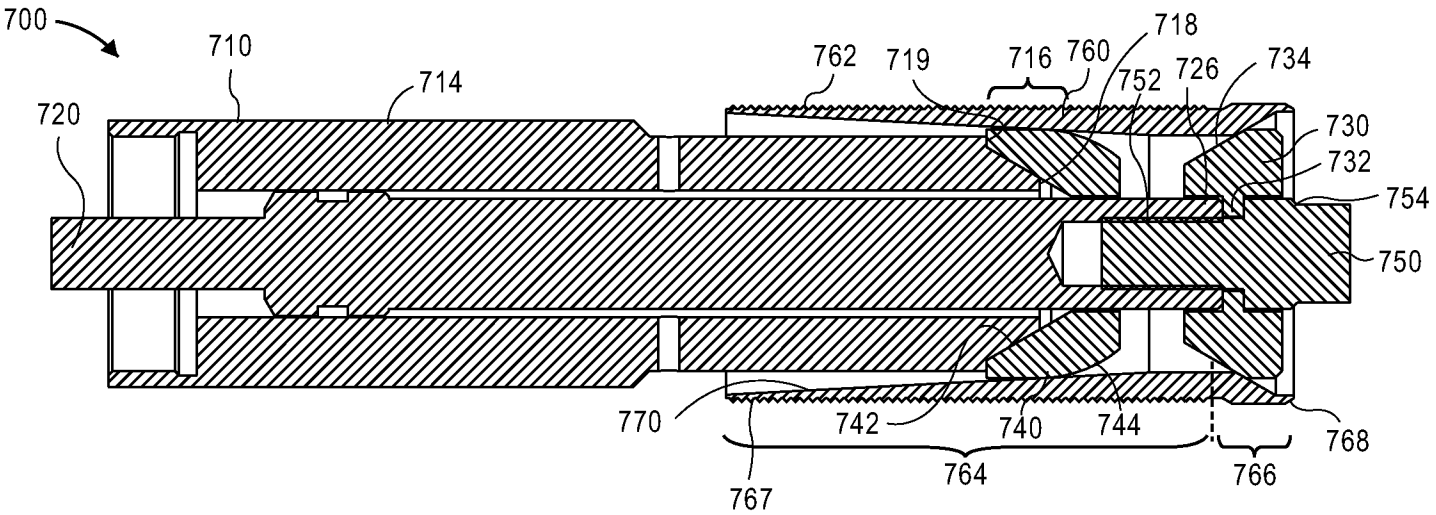
FIG. 9 illustrates a cross-sectional side view of the downhole tool of FIG. 7 after a sleeve has been set, according to an embodiment.

FIG. 9 illustrates a cross-sectional side view of the downhole tool 700 after the expandable sleeve 760 has been set, according to an embodiment. As the second body 730 moves axially-uphole, the lower axial portion 766 of the expandable sleeve 760 may slide up the tapered outer surface 734 of the second body 730. In addition, the upper axial portion 764 of the expandable sleeve 760 may slide up the outer surface 744 of the first body 740. As a result, the first body 740 (and potentially the second body 730 as well) may push the expandable sleeve 760 radially-outward so that the outer surface 762 of the expandable sleeve 760 may contact and set in the surrounding tubular (not shown).

In some embodiments, to set the expandable sleeve 760, the outer surface 762 may form a high-friction interface with the surrounding tubular, e.g., with sufficient friction to avoid axial displacement of the expandable sleeve 760 with respect to the surrounding tubular, once set therein. In an embodiment, the outer surface 762 may be applied with, impregnated with, or otherwise include grit. For example, such grit may be provided by a carbide material or another type of material. Illustrative materials on the outer surface 762 of the expandable sleeve 760 may be found in U.S. Pat. No. 8,579,024, which is incorporated by reference above. In some embodiments, the grit may be provided as a thermal-spray metal, such as WEARSOX®, for example, as disclosed in U.S. Pat. No. 7,487,840, and/or U.S. Patent Publication No. 2015/0060050, incorporated by reference above. In other embodiments, the outer surface 762 may include teeth, wickers, buttons, designed to bite into (e.g., partially embed in) another material.

The force required to pull the inner body 720, the second body 730, the locking mechanism 750, and the expandable sleeve 760 in the uphole direction may increase as the expandable sleeve 760 moves in the uphole direction with respect to the first body 740 due to the decreasing diameter of the inner surface 770 of the upper axial portion 764 of the expandable sleeve 760 (proceeding in the downhole direction). When the force reaches or exceeds a predetermined amount, a portion of the downhole tool 700, e.g., the protrusion 732, may shear. The setting tool may then be removed, while the first body 740 remains in the expandable sleeve 760, continuing to provide a radially-outward force thereon which causes the expandable sleeve 760 to remain in an expanded, set configuration.

Figure 10:
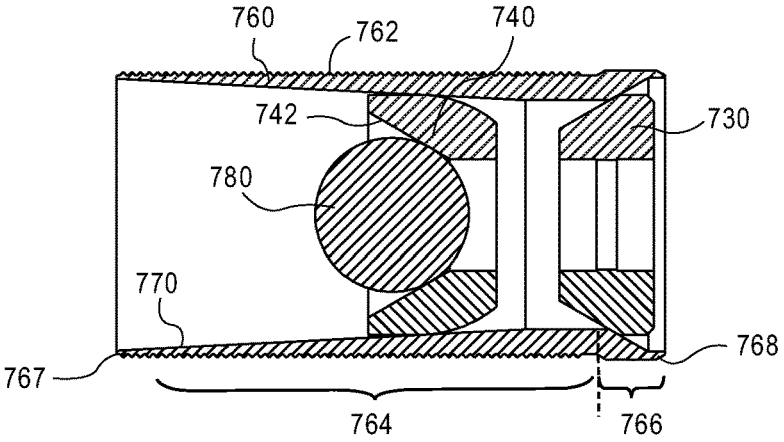
FIGS. 10 and 11 illustrate a cross-sectional side view and a cross-sectional perspective view, respectively, of a portion of the downhole tool of FIG. 7 after a setting tool is removed and a ball is received in a swage, according to an embodiment.
Figure 11:
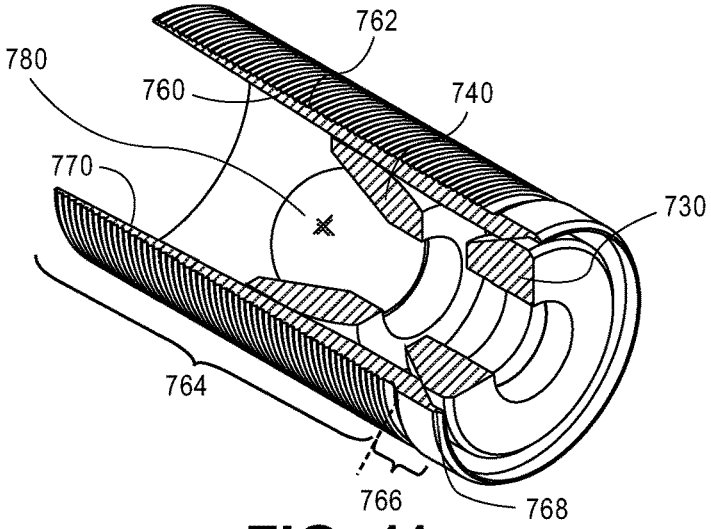

FIGS. 10 and 11 illustrate a cross-sectional side view and a cross-sectional perspective view, respectively, of the downhole tool 700 after the setting sleeve 710 and the inner body 720 are removed and an isolation device 780 is received in a seat provided by the first body 740, according to an embodiment. As shown, the protrusion 732 of the second body 730 may shear, allowing the inner body 720 and the locking mechanism 750 to be pulled back to the surface, while the second body 730 and/or the first body 740 remain(s) positioned within the expandable sleeve 760. In another embodiment, rather than the protrusion 732 shearing, the threaded engagement between the inner body 720 and the locking mechanism 750 may shear, allowing the inner body 720 to be pulled back to the surface, while the second body 730 and/or the first body 740 remain(s) positioned within the expandable sleeve 760. In this embodiment, the locking mechanism 750 may fall into the sump of the wellbore. The second body 730 may also disconnect from the expandable sleeve 760 and fall into the sump of the wellbore.

Referring back to FIG. 8, the method 800 may also include perforating a surrounding tubular with a perforating gun, as at 806. The surrounding tubular may be the tubular that the expandable sleeve 760 engages and bites into. In at least one embodiment, the surrounding tubular may be perforated after the expandable sleeve 760 contacts and bites into the surrounding tubular.

The method 800 may also include introducing the isolation device 780 into a wellbore, as at 808. As shown in FIGS. 10 and 11, the isolation device 780 may be received in the first body 740. More particularly, the isolation device 780 may be received in the optional tapered inner surface 742 of the first body 740, which may serve as the ball seat in this embodiment. The isolation device 780 may plug the wellbore, isolating the portion of the wellbore above the first body 740 and the isolation device 780 from the portion of the wellbore below the first body 740 and the isolation device 780. In at least one embodiment, the isolation device 780 may be introduced into the wellbore after the surrounding tubular is perforated. Furthermore, as pressure is applied to the isolation device 780, the resultant force may drive the first body 740 further into the expandable sleeve 760, which may in turn increase the expansion of the expandable sleeve 760 and thereby cause the expandable sleeve 760 to more securely set into the surrounding tubular.

Figure 12:
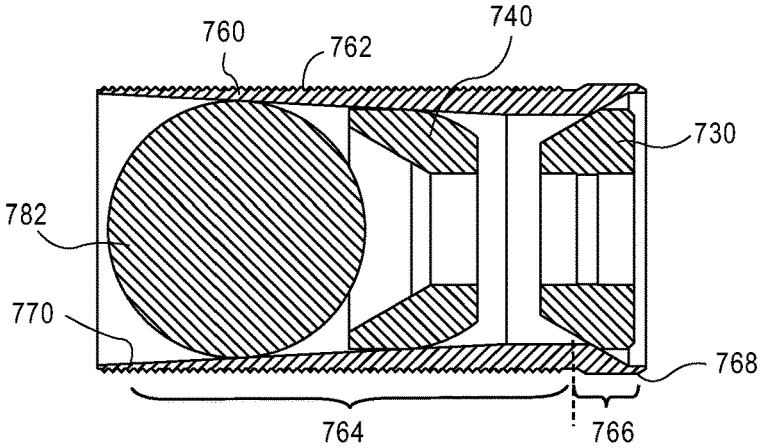
FIG. 12 illustrates a cross-sectional side view of a portion of the downhole tool of FIG. 7 after a ball is received in the sleeve, according to an embodiment.

FIG. 12 illustrates a cross-sectional side view of a portion of the downhole tool 700 after a different (e.g., larger) isolation device 782 is received in the expandable sleeve 760, according to an embodiment. In another embodiment, the isolation device 782 may have a larger diameter such that the isolation device 780 is received in (i.e., contacts) the expandable sleeve 760, proximal to the first body 740, such that the expandable sleeve 760, rather than the first body 740, provides the ball seat, e.g., proximal to the first body 740. The larger isolation device 782 may be sized to engage the expandable sleeve 760, exerting an additional radially-outward force on the expandable sleeve 760 when exposed to a pressure.

Referring back to FIG. 8, the method 800 may also include increasing a pressure of a fluid in the wellbore, as at 810. The isolation provided by the isolation device 780, 782, may allow the pressure to be increased (e.g., using a pump at the surface) above the isolation device 780, 782, while preventing such increase below the isolation device 780, 782. The increased pressure may cause the subterranean formation around the wellbore to fracture. This may take place after perforation takes place.

In at least one embodiment, the first body 740, the expandable sleeve 760, and/or the isolation device 780, 782 may be made of a material that dissolves after a predetermined amount of time in contact with a liquid in the wellbore. The predetermined amount of time may be from about 6 hours to about 12 hours, from about 12 hours to about 24 hours, from about 1 day to about 2 days, from about 2 days to about 1 week, or more. In some embodiments, the expandable sleeve 760 may be made at least partially from a metal (e.g., aluminum), while the first body 740 and/or the isolation device 780 or 782 may be made from a dissolvable material (e.g., a material that includes magnesium), such that the sleeve 760 may remain substantially intact after the dissolvable material is dissolved. Further, in some embodiments, all or a portion of a surface of any dissolvable component may include grooves, or other structures configured to increase a surface area of the surface, so as to increase the rate of dissolution.

Figure 13:
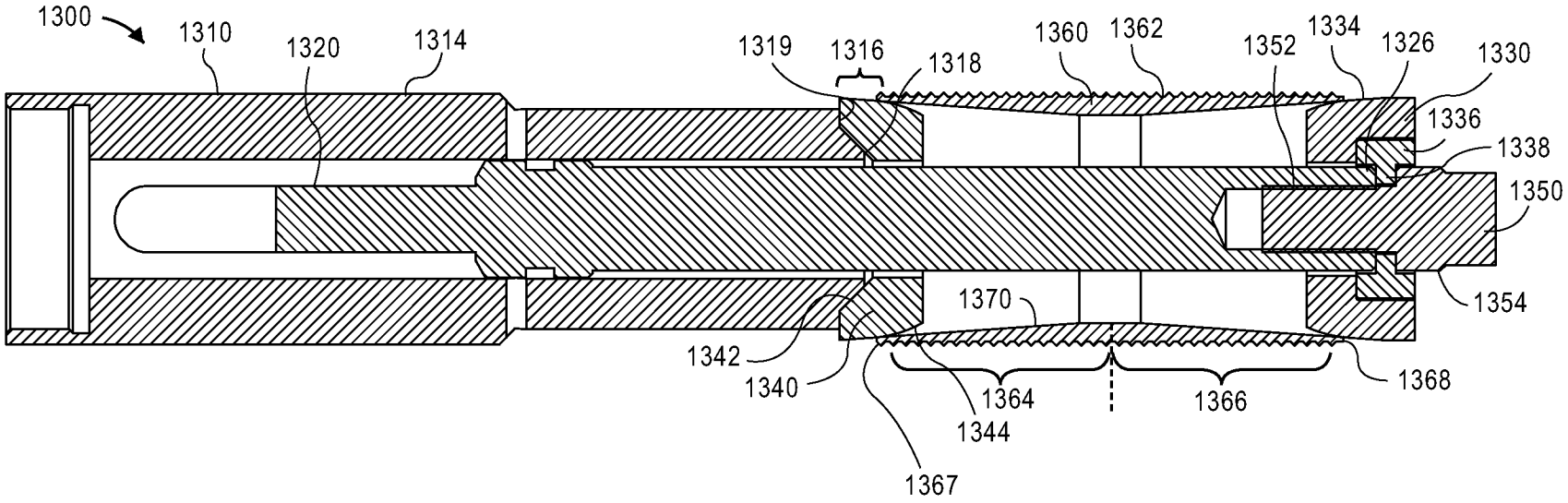
FIG. 13 illustrates a cross-sectional side view of another downhole tool in a first, run-in configuration, according to an embodiment.

FIG. 13 illustrates a cross-sectional side view of another downhole tool 1300 in a first, run-in configuration, according to an embodiment. The downhole tool 1300 may include a setting tool having a setting sleeve 1310 and an inner body 1320. The downhole tool 1300 may also include a first body 1330, a second body 1340, and a generally cylindrical, expandable sleeve 1360. In this embodiment, the first and second bodies 1330, 1340 may provide swages that serve to expand the expandable sleeve 1360, e.g., deform the expandable sleeve 1360 radially outwards, as they are moved relative to the expandable sleeve 1360 during setting, as will be described in greater detail below.

For example, the first body 1330 may be positioned proximate to a lower axial end 1326 of the inner body 1320 and a lower axial end 1368 of the expandable sleeve 1360. The first body 1330 may have a bore formed axially-therethrough, and the inner body 1320 may be received at least partially therein. An outer surface 1334 of the first body 1330 may be tapered such that a cross-sectional width of the outer surface 1334 of the first body 1330 decreases proceeding toward the upper axial end of the first body 1330. As such, the outer surface 1334 of the first body 1330 may be oriented at an acute angle with respect to the central longitudinal axis through the downhole tool 1300.

The second body 1340 may be positioned proximate to the upper axial end 1367 of the expandable sleeve 1360, opposite to the first body 1330. Further, the second body 1340 may be positioned adjacent to a lower axial end 1318 of the setting sleeve 1310. Optionally, the setting sleeve 1310 and the second body 1340 may form a tapered engagement therebetween. For example, the second body 1340 may include an inner surface 1342 that is tapered at substantially the same angle as a tapered portion 1316 of the setting sleeve 1310. As an additional option, an upper axial end of the second body 1340 may abut (e.g., directly or indirectly) a shoulder 1319 of the setting sleeve 1310.

The outer surface 1334 of the first body 1330 and/or the inner surface 1370 of the expandable sleeve 1360 may be provided with a high-friction coating, such as a grit. In some embodiments, the grit may be provided as a thermal-spray metal, such as WEARSOX®, for example, as disclosed in U.S. Pat. No. 7,487,840, and/or U.S. Patent Publication No. 2015/0060050, incorporated by reference above. Alternatively or additionally, the outer surface 1334 and/or the inner surface 1370 may be provided with teeth, buttons, or a ratcheting mechanism. The function of such coating, teeth, buttons, and/or ratcheting mechanism is to maintain the position of the first body 1330 relative to the expandable sleeve 1360, so as to resist the first body 1330 being pushed out of the bore of the expandable sleeve 136 when in the expanded configuration, as will be explained in greater detail below. The outer surface of the second body 1340 may include a similar coating, grit, buttons, teeth, ratcheting mechanism, etc., again to resist displacement of the second body 1340 relative to the expandable sleeve 1360 when the tool 1300 is in the set configuration.

Further, the second body 1340 may have a bore formed axially-therethrough, through which the inner body 1320 may pass. At least a portion of an outer surface 1344 of the second body 1340 may be tapered (conical or spherical) such that the cross-sectional width (e.g., diameter) of the outer surface 1344 of the second body 1340 decreases proceeding toward the lower axial end of the second body 1340.

A shear ring 1336 may be positioned within a recess in the first body 1330. The shear ring 1336 may include the protrusion 1338 that is positioned axially-between the lower axial end 1326 of the inner body 1320 and a head 1354 of a locking mechanism 1350. The locking mechanism 1350 may also include a shank 1352 that may be attached to the lower axial end 1326 of the inner body 1320.

The expandable sleeve 1360 may thus be positioned at least partially axially-between the first and second bodies 1330, 1340 when the downhole tool 1300 is in the first, run-in position. Further, the expandable sleeve 1360 may be positioned radially-outward from the inner body 1320, the first and second bodies 1330, 1340, or a combination thereof.

The upper axial portion 1364 of the sleeve 1360 may be tapered. As such, a thickness of the upper axial portion 1364 of the sleeve 1360 may decrease proceeding toward the upper axial end 1367 of the sleeve 1360. The inner surface 1370 of the upper axial portion 1364 of the expandable sleeve 1360 may be oriented at an acute angle with respect to the central longitudinal axis through the downhole tool 1300.

The lower axial portion 1366 of the sleeve 1360 may also be tapered. As such, a thickness of the lower axial portion 1366 of the sleeve 1360 may decrease proceeding toward the lower axial end 1368 of the sleeve 1360. The inner surface 1370 of the lower axial portion 1366 of the sleeve 1360 may be oriented at an acute angle with respect to the central longitudinal axis through the downhole tool 1300. In an embodiment, the upper and lower axial portions 1364, 1366 may be oriented at substantially the same angles (but mirror images of one another).

Figure 14:
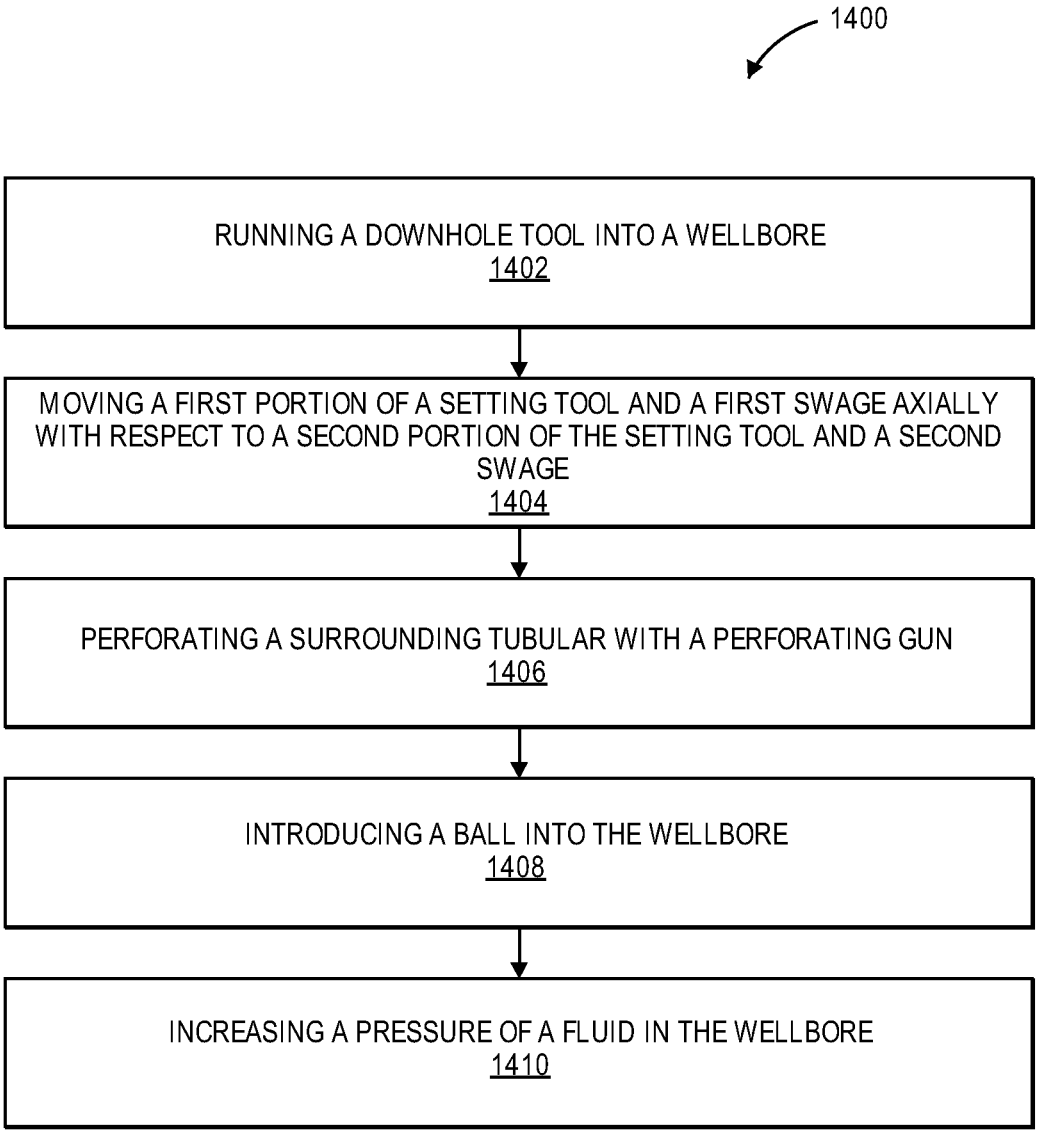
FIG. 14 illustrates a flowchart of another method for actuating the downhole tool of FIG. 13, according to an embodiment.

FIG. 14 illustrates a flowchart of a method 1400 for actuating the downhole tool 1300, according to an embodiment. An example of the method 1400 may be understood with reference to the downhole tool 1300 of FIGS. 13 and 15-18. The method 1400 includes running a downhole tool (e.g., the downhole tool 1300) into a wellbore in a first, run-in configuration, as at 1402.

The method 1400 may also include moving a first portion of a setting tool and a first swage axially with respect to a second portion of the setting tool and a second swage, as at 1404. This may actuate the sleeve 1360 radially-outward into a "set" position. For example, the first and second bodies 1330, 1340 may provide such first and second swages. Further, such moving may be effected by pulling the inner body 1320, the first body 1330, the locking mechanism 1350 and the expandable sleeve 1360 in an uphole direction, or by pushing the setting sleeve 1310, the second body 1340, and the expandable sleeve 1360 in a downhole direction, or both.

During such movement, the first and second bodies 1330 move with respect to the expandable sleeve 1360. The movement of the first body 1330 with respect to the expandable sleeve 1360 causes the lower axial portion 1366 of the expandable sleeve 1360 to expand radially-outward, while the movement of the second body 1340 with respect to the expandable sleeve 1360 causes the upper axial portion 1364 of the expandable sleeve 1360 to expand radially-outward.

Figure 15:
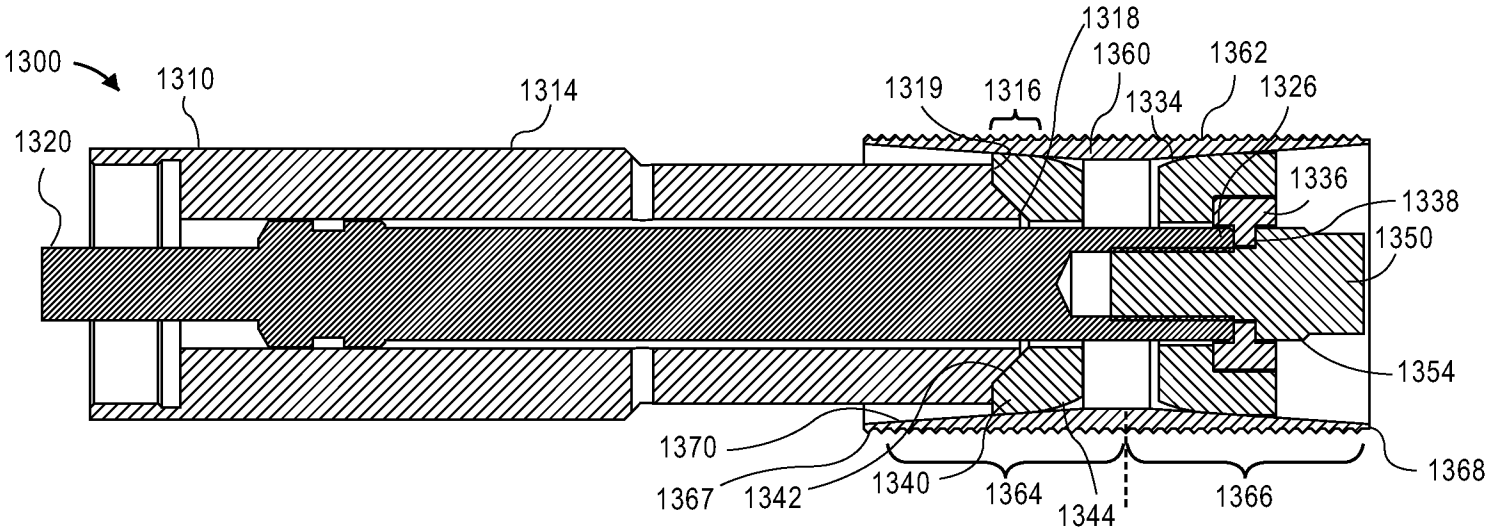
FIG. 15 illustrates a cross-sectional side view of the downhole tool of FIG. 13 after a sleeve has been set, according to an embodiment.

FIG. 15 illustrates a cross-sectional side view of the downhole tool 1300 after the sleeve 1360 has been set (i.e., in a "set configuration" of the downhole tool 1300), according to an embodiment. As the first body 1330 moves axially-uphole, the lower axial portion 1366 of the sleeve 1360 may slide up the tapered outer surface 1334 of the first body 1330. In addition, the upper axial portion 1364 of the sleeve 1360 may slide up the outer surface 1344 of the second body 1340. Thus, as shown, the distance between the first and second bodies 1330, 1340 may decrease. As the first and second bodies 1330, 1340 move closer together, the first and second bodies 1330, 1340 may push the sleeve 1360 radially-outward so that the outer surface 1362 of the sleeve 1360 sets in the surrounding tubular.

In some embodiments, to set the expandable sleeve 1360, the outer surface 1362 may form a high-friction interface with the surrounding tubular, e.g., with sufficient friction to avoid axial displacement of the expandable sleeve 1360 with respect to the surrounding tubular, once set therein. In an embodiment, the outer surface 1362 may be applied with, impregnated with, or otherwise include grit. For example, such grit may be provided by a carbide material. Illustrative materials on the outer surface 1362 of the expandable sleeve 1360 may be found in U.S. Pat. No. 8,579,024, which is incorporated by reference above. In some embodiments, the grit may be provided as a thermal-spray metal, such as WEARSOX®, for example, as disclosed in U.S. Pat. No. 7,487,840, and/or U.S. Patent Publication No. 2015/0060050, incorporated by reference above. In other embodiments, the outer surface 1362 may include teeth, buttons, and/or wickers designed to bite into (e.g., partially embed in) another material.

The force required to move the first and second bodies 1330, 1340 with respect to the expandable sleeve 1360 may increase as the movement continues, due to the tapered inner surface 1370. When the force reaches or exceeds a predetermined amount, a portion of the downhole tool 1300, e.g., the shear ring 1336, may shear, releasing the inner body 1320 from the first body 1330. The first and second bodies 1330, 1340 may thus remain in the expandable sleeve 1360 after the setting tool is removed, such that the first and second bodies 1330, 1340 continue to provide a radially outward force on the expandable sleeve 1360, keeping the expandable sleeve 1360 in engagement with the surrounding tubular.

Figure 16:
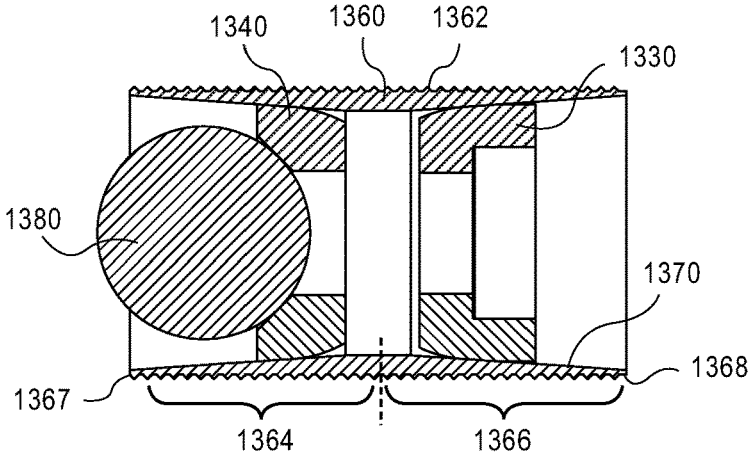
FIGS. 16 and 17 illustrate a cross-sectional side view and a cross-sectional perspective view, respectively, of a portion of the downhole tool of FIG. 13 after a setting tool is removed and a ball is received in a swage, according to an embodiment.
Figure 17:
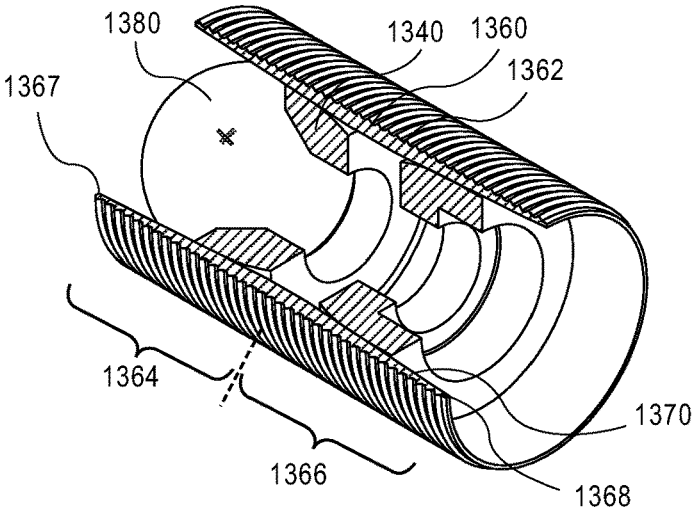

FIGS. 16 and 17 illustrate a cross-sectional side view and a cross-sectional perspective view, respectively of a portion of the downhole tool 1300 after the setting sleeve 1310 and the inner body 1320 are removed, and an isolation device 1380 is received in the second body 1340, according to an embodiment. Accordingly, an axial force on the isolation device 1380 generated by the pressure in the wellbore may be transmitted from the isolation device 1380 to the first body 1340, thereby tending to cause the first body 1340 to be driven further into the expandable sleeve 1360. This may increase the radial outward gripping force that the expandable sleeve 1360 applies to the surrounding tubular.

In another embodiment, the isolation device 1380 may be larger, and may be received by the expandable sleeve 1360, proximate to the first body 1330. The larger isolation device 1380 may also be sized to further radially expand the expandable sleeve 1360 by transmitting at least a portion of a force incident on the isolation device 1380 due to pressure in the wellbore to a radial outward force on the expandable sleeve 1360. As shown, the protrusion 1338 of the shear ring 1336 may shear, allowing the inner body 1320 and the locking mechanism 1350 to be pulled back to the surface, while the first and second bodies 1330, 1340 remain positioned within the sleeve 1360. In another embodiment, rather than the protrusion 1338 shearing, the threaded engagement between the inner body 1320 and the locking mechanism 1350 may shear, allowing the inner body 1320 to be pulled back to the surface, while the first and second bodies 1330, 1340 remain positioned within the sleeve 1360. In this embodiment, the locking mechanism 1350 may fall into the sump of the wellbore.

Referring back to FIG. 14, the method 1400 may also include perforating a surrounding tubular with a perforating gun, as at 1406. The surrounding tubular may be the tubular that the sleeve 1360 engages and bites into. In at least one embodiment, the surrounding tubular may be perforated after the sleeve 1360 contacts and "bites into" the surrounding tubular.

The method 1400 may also include introducing the isolation device 1380 into a wellbore, as at 1408. As shown in FIGS. 16 and 17, the isolation device 1380 may be received in the second body 1340. More particularly, the isolation device 1380 may be received in the tapered inner surface 1342 of the second body 1340, which may serve as a ball seat. The isolation device 1380 may plug the wellbore, isolating the portion of the wellbore above the second body 1340 and the isolation device 1380 from the portion of the wellbore below the second body 1340 and the isolation device 1380. In another embodiment, the isolation device 1380 may engage the expandable sleeve 1360 and apply a radially outward force thereon, while blocking flow through the interior of the expandable sleeve 1360. In at least one embodiment, the isolation device 1380 may be introduced into the wellbore after the surrounding tubular is perforated.

Figure 18:
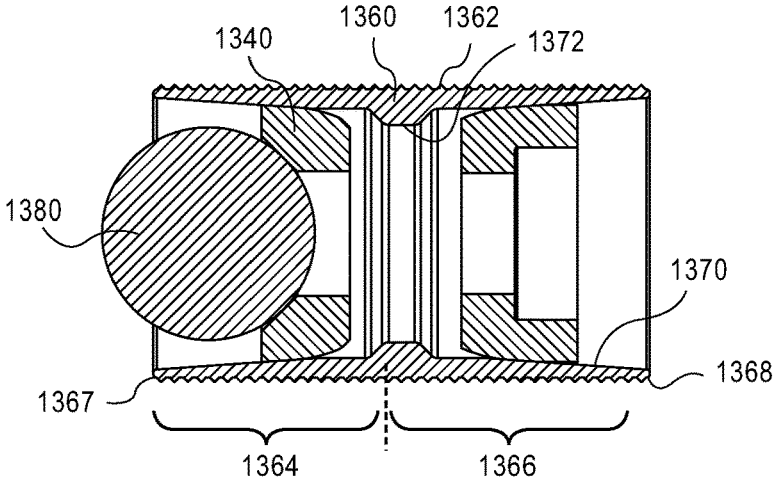
FIG. 18 illustrates a cross-sectional side view of a portion of the downhole tool of FIG. 13 after the setting tool is removed and the ball is received in a swage, where the sleeve includes an inner shoulder, according to an embodiment.

FIG. 18 illustrates a cross-sectional side view of a portion of the downhole tool 1300 after the isolation device 1380 is received in the second body 1340, where the sleeve 1360 includes an inner shoulder 1372, according to an embodiment. In at least one embodiment, the shoulder 1372 extends radially-inward from the inner surface 1370 of the sleeve 1360. The shoulder 1372 may be positioned generally between the upper axial portion 1364 and the lower axial portion 1366. The shoulder 1372 may limit the axial movement of at least one of the first and second bodies (e.g., swages) 1330, 1340 with respect to the sleeve 1360.

More particularly, in an embodiment, the inner surface 1370 in the upper and lower axial portions 1364, 1366 may be tapered, such that the inner diameter thereof decreases as proceeding toward the shoulder 1372. The shoulder 1372 may extend radially-inward from the inner surface 1370, such that the shoulder 1372 defines generally axially-facing bearing end faces against which the respective first and second bodies 1330, 1340 may abut. In at least some embodiments, the end faces may define obtuse angles with respect to the inner surface 1370, as shown.

In some embodiments, whether a shoulder 1372 is provided or not, the first and second bodies 1330, 1340 may include interlocking, axially-extending protrusions that are configured to radially overlap when the tool 1300 is in the set configuration. As such, the first and second bodies 1330, 1340 may be locked to one another, so as to further resist displacement thereof relative to the sleeve 1360 when in the set configuration.

Referring back to FIG. 14, the method 1400 may also include increasing a pressure of a fluid in the wellbore, as at 1410. Due to the isolation provided by the isolation device 1380, the pressure may be increased (e.g., using a pump at the surface) above the isolation device 1380 but not below the isolation device 1380. The increased pressure may cause the subterranean formation around the wellbore to fracture. This may take place after perforation takes place.

In at least one embodiment, the first and second bodies 1330, 1340, the sleeve 1360, and/or the isolation device 1380 may be made of a material that dissolves after a predetermined amount of time in contact with a liquid in the wellbore. The predetermined amount of time may be from about 6 hours to about 12 hours, from about 12 hours to about 24 hours, from about 1 day to about 2 days, from about 2 days to about 1 week, or more. In some embodiments, the sleeve 1360 may be made from a material (e.g., aluminum) that does not dissolve in the liquid in the wellbore, while the first body 1130, the second body 1340, and/or the isolation device 1380 is made from a material (e.g., magnesium) that dissolves in the liquid, such that the sleeve 1360 may remain intact after the dissolvable material is dissolved.

In any of the foregoing embodiments, the isolation device received on either the expandable sleeve or the first or second body may be configured to come off of its seat, thereby allowing for flowback, uphole, through the downhole tool. This may facilitate introduction of fluids configured to dissolve the dissolvable components of the downhole tool in the wellbore. Further, the expandable sleeve and/or the first or second body may be ported, to allow for such fluid to pass, at a predetermined (low) flow rate past the isolation device, so as to facilitate dissolving the dissolvable component(s) of the tool. In addition, various process or techniques may be employed to increase the rate at which the dissolvable component(s) dissolve. For example, if the expandable sleeve is dissolvable, notches or cuts may be made in the inner surface thereof, which increase the surface area in contact with the wellbore fluids and thus increase the rate at which the sleeve dissolves. Further, in at least some embodiments, a sealing element (e.g., an elastomeric member) may be positioned around the expandable sleeve, e.g., on the outer surface thereof, to form a seal with the surrounding tubular, when the expandable sleeve is expanded. In some embodiments, all or a portion of a surface of any dissolvable component may include grooves, or other structures configured to increase a surface area of the surface, so as to increase the rate of dissolution.

Figure 19:
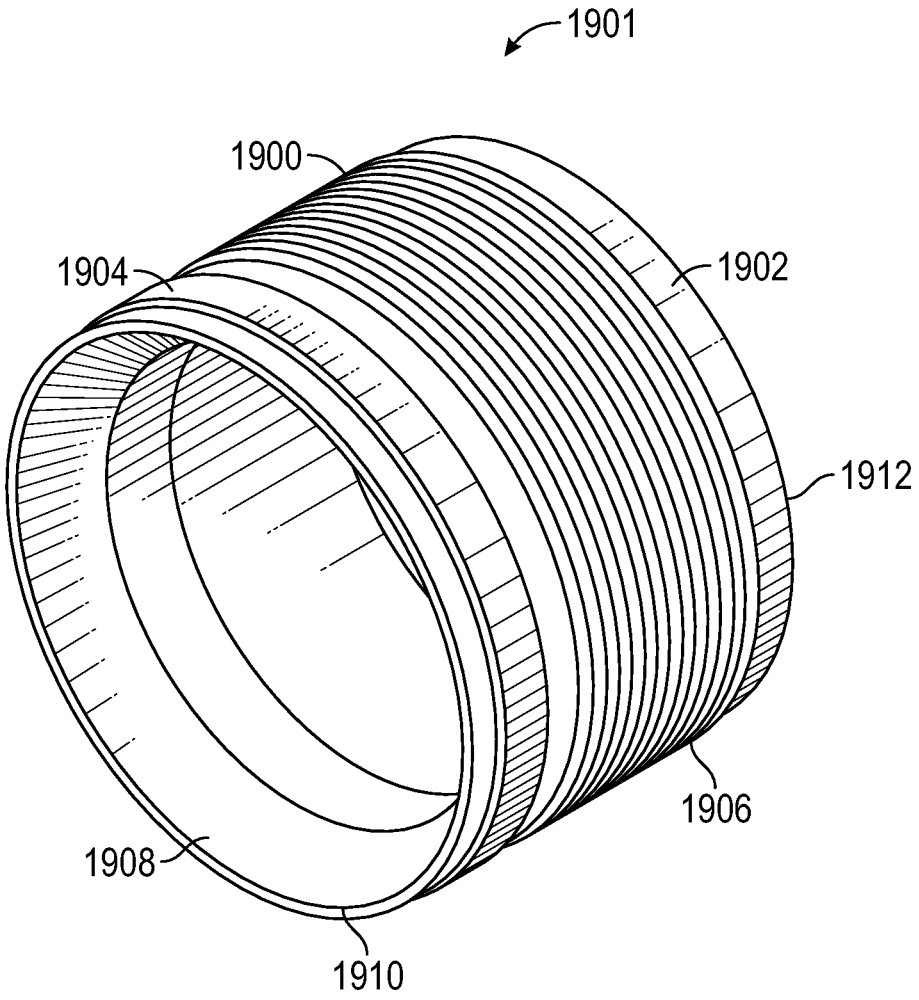
FIG. 19 illustrates a perspective view of another expandable sleeve, according to an embodiment.

FIG. 19 illustrates a perspective view of another expandable sleeve 1900 of a downhole tool 1901, according to an embodiment. The sleeve 1900 includes a body 1902 and may include a seal member 1904 positioned around the body 1902. The sleeve 1900 may define engaging members 1906, such as teeth, wickers, buttons, grit, high-friction coatings, etc., on an outer surface of the body 1902. For example, the engaging members 1906 may be provided by a grit applied (e.g., coated) on the outer surface of the expandable sleeve 1900. The grit may be provided by a carbide material. Illustrative materials on the outer surface of the expandable sleeve 1900 may be found in U.S. Pat. No. 8,579,024, which is incorporated by reference above. In some embodiments, the grit may be provided as a thermal-spray metal, such as WEARSOX®, for example, as disclosed in U.S. Pat. No. 7,487,840, and/or U.S. Patent Publication No. 2015/0060050, incorporated by reference above.

Internally, the sleeve 1900 may include a profiled, e.g., tapered, interior surface or shoulder 1908 defined in the body 1902. In some embodiments, the shoulder 1908 may not be tapered but may extend straight in a radial direction or may be radiused.

In one embodiment, the body 1902 may be made from a dissolvable material, such as a dissolvable alloy or a dissolvable composite. The dissolvable material may be configured to dissolve over a predetermined amount of time or upon contact with a specific type of fluid. In other embodiments, the body 1902 may be made from a material, such as aluminum, that may not be configured to dissolve in the fluid. Further, in some embodiments, all or a portion of a surface of any dissolvable component may include grooves, or other structures configured to increase a surface area of the surface, so as to increase the rate of dissolution. As will be described herein, the sleeve 1900 is configured to be expanded from a first outer diameter to a second larger outer diameter upon application of a radial force.

As shown in FIG. 19, the seal member 1904 may be disposed proximate to a first or "uphole" end 1910 of the sleeve 1900 (e.g., adjacent to the shoulder 1908). Further, the engaging members 1906 may be disposed adjacent to a second or "downhole" end 1912 of the sleeve 1900. In other embodiments, the relative positioning of the seal member 1904 and the engaging members 1906 may be switched. As shown, the seal member 1904 may be a separate component that is attached to the body 1902, e.g., an O-ring, elastomeric band, or the like that may seat in a groove formed in the outer surface of the body 1902 and may, in some embodiments, be bonded thereto. In another embodiment, the seal member 1904 may be part of the sleeve 1900, e.g., integral therewith.

Although the illustrated embodiment depicts an embodiment in which the sleeve 1900 includes both the seal member 1904 and the engaging member 1906 on the body 1902, in another embodiment, the seal member 1904 and/or the engaging member 1906 may be optional and potentially omitted. In other words, the body 1902 of the sleeve 1900 may create a seal with the surrounding tubular upon expansion of the sleeve 1900 when the seal member 1904 is not used. Additionally, the body 1902 of the sleeve 1900 may grip the surrounding tubular upon expansion of the sleeve 1900 when the engaging member 1906 is not used.

Figure 20:
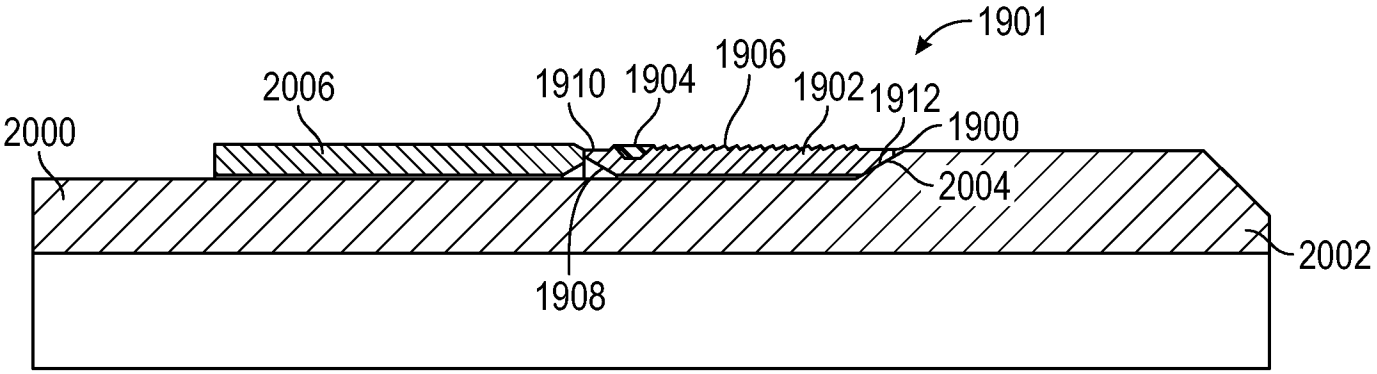
FIG. 20 illustrates a side, cross-sectional view of another downhole tool in a run-in configuration, according to an embodiment.

FIG. 20 illustrates a partial sectional view of the downhole tool 1901 in a run-in configuration, according to an embodiment. The tool 1901 includes a setting tool 2000, which may include an inner body 2002 extending through the expandable sleeve 1900. The inner body 2002 may define a ramped surface 2004, e.g., as part of a protrusion extending outward therefrom. For example, the ramped surface 2004 may abut the second end 1912 of the expandable sleeve 1900 in the illustrated run-in configuration.

The setting tool 2000 may also include a setting sleeve 2006 positioned around the body 2002. The setting sleeve 2006 may be positioned axially adjacent to the expandable sleeve 1900, opposite to the ramped surface 2004 and may abut the first end 1910 of the sleeve 1900. For example, in the run-in position, the sleeve 1900 may be disposed between the setting sleeve 2006 and the ramped surface

2004, which may prevent the sleeve 1900 from moving axially. In some embodiments, an amount of space may be provided between the expandable sleeve 1900 and either or both of the ramped surface 2004 and/or the setting sleeve 2006. Further, it will be appreciated that the illustrated setting tool is but one example among many, and other setting tools, such as one or more embodiments of the setting tools described above or others (e.g., rotary expanders) may be employed without departing from the scope of the present disclosure.

Figure 21:
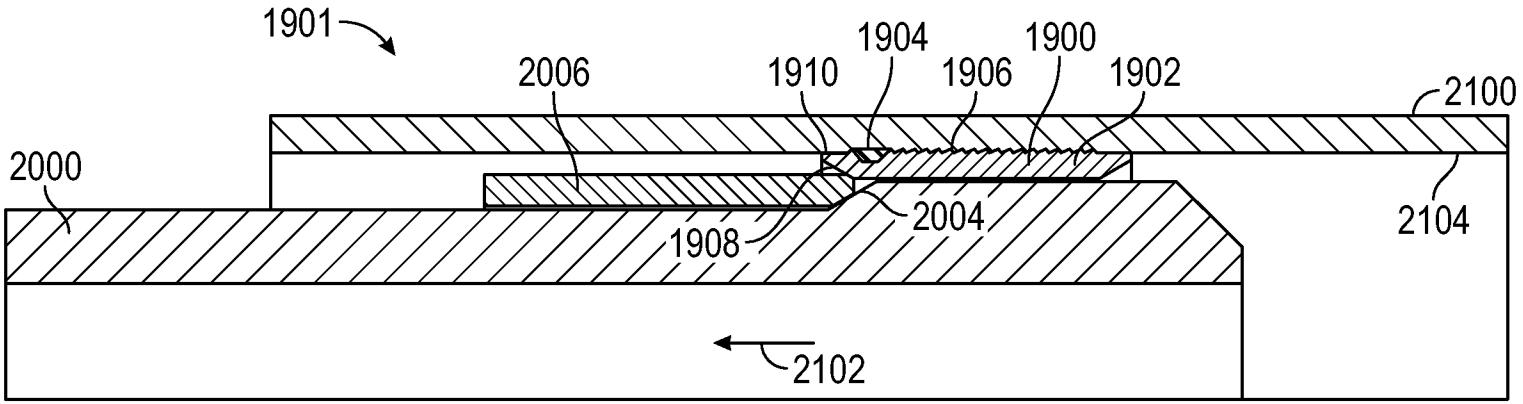
FIG. 21 illustrates a side, cross-sectional view of the downhole tool of FIG. 20, but in a set configuration, according to an embodiment.

FIG. 21 illustrates a sectional view of the sleeve 1900 in a set configuration within a surrounding tubular 2100 (e.g., casing, liner, wellbore wall, etc.), according to an embodiment. The setting tool 2000 and the sleeve 1900 may be run into a wellbore and placed within the tubular 2100 using coiled tubing, wireline or slickline, or any other conveyance system. Once the sleeve 1900 is deployed to a desired position in the tubular 2100, the setting tool 2000 may be activated to expand and set the sleeve 1900, thereby actuating the tool 1901 into the illustrated set configuration.

During activation of the setting tool 2000, the inner body 2002 may be pulled axially with respect to the sleeve 1900, e.g., in the direction indicated by arrow 2102. The body 2002 may be prevented from moving by an opposite force applied by the setting sleeve 2006. In other embodiments, the body 2002 may be stationary and the setting sleeve 2006 may push the sleeve 1900 axially with respect to the body 2005. In still other embodiments, both the setting sleeve 2006 and the body 2002 may be moved axially during setting.

Such relative movement causes the sleeve 1900 to move up the ramped surface 2004, beginning with the second end 1912 and at least partially, e.g., entirely, across the body 1902 to the first end 1910. As a result, the sleeve 1900 is radially expanded from a first outer diameter to a second, larger outer diameter. The ramped surface 2004 may thus be considered a swage. The second outer diameter may be at least as large as the inner diameter of the tubular 2100, and thus the sleeve 1900 may be pressed into engagement with an inner surface 2104 of the tubular 2100. Since the body 1902 (and the shoulder 1908) may be expanded when the sleeve 1900 is expanded, the shoulder 1908 may also increase in diameter correspondingly (potentially, but not necessarily to the same degree or proportionally).

When the sleeve 1900 engages the tubular 2100, the seal member 1904 may form a seal with the tubular 2100, and the engaging members 1906 may bite into or otherwise form a high-friction interface with the inner surface 2104 of the tubular 2100. After the sleeve 1900 is engaged with the tubular 2100, the setting tool 2000, which may have been moved axially through the sleeve 1900, may be removed from the tubular 2100.

Figure 22:
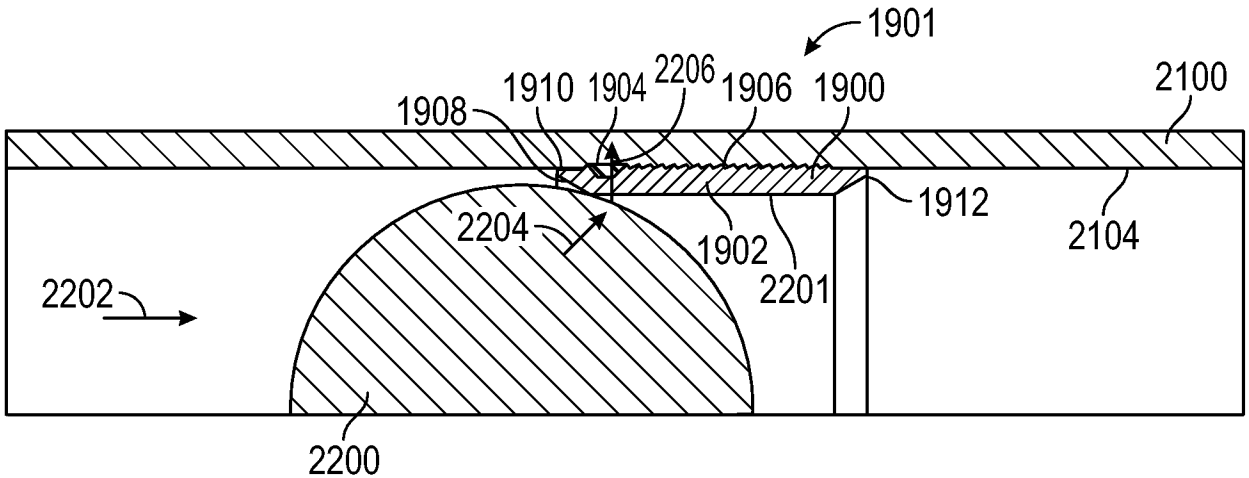
FIG. 22 illustrates a side, cross-sectional view of the downhole tool of FIGS. 20 and 21, engaging an isolation device, according to an embodiment.

FIG. 22 illustrates a sectional view of the downhole tool 1901 in the set configuration, with an isolation device 2200 disposed in the sleeve 1900, according to an embodiment. As shown, the setting tool 2000 has been removed to provide an open through-bore 2201 through the sleeve 1900, allowing fluid communication axially through the sleeve 1900 unless plugged. Further, the shoulder 1908 may face in an uphole direction, such that it is configured to engage or "catch" the isolation device 2200 deployed into the wellbore.

The isolation device 2200 may be a ball, dart, or any other type of obstructing member that may be deployed into the wellbore. In an embodiment, the isolation device 2200 may be made from a dissolvable material, which may be configured to dissolve in the presence of a particular fluid (e.g., an acid) for a certain amount of time.

In operation, after the sleeve 1900 is placed within the tubular 2100, the tubular 2100 may be perforated using a perforating gun (not shown). Next, the isolation device 2200 is dropped or pumped into the wellbore and subsequently is received in the sleeve 1900. The isolation device 2200 is configured to cooperate with the sleeve 1900, e.g., the shoulder 1908, to close off the bore 2201 of the sleeve 1900. This may isolate regions of the wellbore uphole of the tool 1901 from those downhole of the tool 1900. Thus, frac fluid injected into the wellbore during a fracking operation may be directed through the perforations, rather than through the bore 2201 of the sleeve 1900.

Furthermore, during the fracking operation, the frac fluid may apply a pressure, which in turn applies a force, generally in the axial direction indicated by arrow 2202, on the isolation device 2200. As a result, the isolation device 2200 may apply a force, as indicated by arrow 2204, on the sleeve 1900. Since the isolation device 2200 bears against the shoulder 1908, which may be formed as a tapered or wedge-shaped structure (in cross-section), this axial force may be partially transferred to radially-outward force, as indicated by arrow 2206. Thus, increased pressure in the wellbore uphole of tool 1901 may serve to enhance the seal by the sealing member 1904 and/or the grip of the engaging members 1906 with the surrounding tubular 2100.

After the first fracking operation is complete, another sleeve may be run into the tubular 2100 at a location above the sleeve 1900, and the process may be repeated until several (e.g., all) of the zones in the wellbore are fractured. Each sleeve may be configured to receive the same size isolation device. As mentioned above, the isolation device 2200 may be made from a dissolvable material. Accordingly, after the fracking operation is complete, the isolation device 2200 may be removed by introducing the solvent thereto (or by waiting for a certain amount of time if the solvent is already present). Similarly, the sleeve 1900 itself may be dissolvable, and thus the sleeve 1900 may be removed by introducing a solvent thereto. In other embodiments, the sleeve 1900 may be removed by deploying a gripping member and attaching the gripping member to the sleeve and pulling the sleeve from the tubular. In another embodiment, the sleeve 1900 may be removed using a mill or drill bit.

Figure 23:
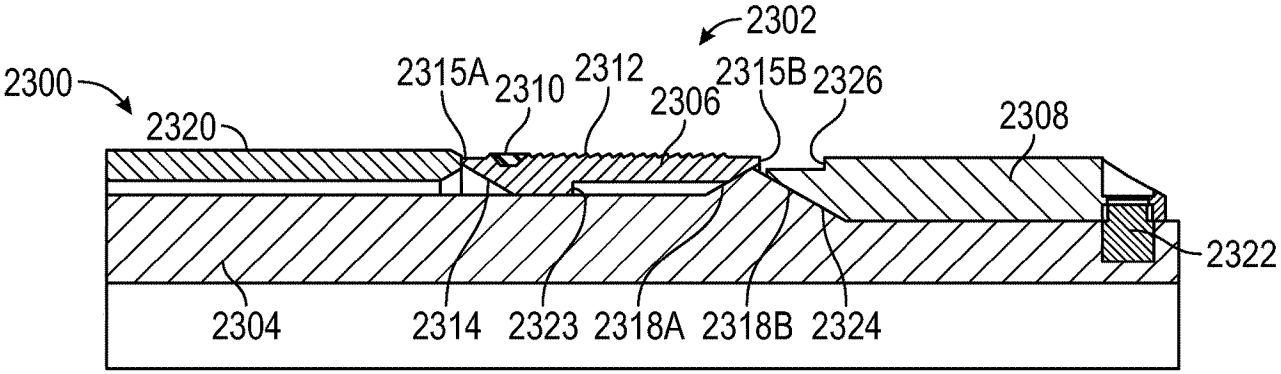
FIG. 23 illustrates a side, cross-sectional view of another downhole tool in a run-in configuration, according to an embodiment.

FIG. 23 illustrates a partial sectional view of another downhole tool 2300 in a run-in configuration, according to an embodiment. The tool 2300 includes an expandable sleeve 2302 and a setting tool 2304. The expandable sleeve 2302, in this embodiment, includes two or more sleeves, e.g., a first sleeve 2306 and a second sleeve 2308, which may be spaced axially apart in the run-in configuration, as shown. Regarding the first sleeve 2306, it may be configured to expand to engage and potentially form a seal with a surrounding tubular, as will be described in greater detail below. Accordingly, a seal member 2310 may be positioned around and, e.g., attached to the first sleeve 2306. Further, the first sleeve 2306 may be provided with engaging members 2312, such as teeth, wickers, grit, or a high-friction surface which may also be defined, attached, or otherwise positioned on an outer surface of the first sleeve 2306. For example, the engaging members 2312 may include a grit made from a carbide material, such as described in U.S. Pat. No. 8,579,024, which is incorporated by reference above. In some embodiments, the grit may be provided as a thermal-spray metal, such as WEARSOX®, for example, as disclosed in U.S. Pat. No. 7,487,840, and/or U.S. Patent Publication No. 2015/0060050, incorporated by reference above.

For example, the seal member 2310 may be positioned proximal to a first end 2315A of the first sleeve 2306, and the engaging members 2312 may be positioned proximal to a second end 2315B of the first sleeve 2306, e.g., opposite to the first end 2315A. In other embodiments, this relative positioning of the engaging members 2312 and the seal member 2310 may be swapped, and/or either or both of the engaging members 2312 and/or the seal member 2310 may be omitted.

Additionally, a first shoulder 2314 may be formed on an inner surface of the first sleeve 2306, e.g., proximate to the first end 2315A and facing in an uphole direction. In some embodiments, the shoulder 2314 may be tapered or wedge shaped. In other embodiments, the shoulder 2314 may be curved or flat. The first sleeve 2306 may also include a second shoulder 2323, which may be spaced axially apart from the first shoulder 2314 and may, in some embodiments, be relatively flat, extending inward in the radial direction.

The setting tool 2304 includes an inner body 2316 having ramped surfaces 2318A, 2318B, which may be adjacent to one another, extend outward from the inner body 2316, and face generally in opposite axial direction, e.g., on either axial side of a protrusion extending outwards from the inner body 2316. In some embodiments, the first sleeve 2306 and the second sleeve 2308 may be positioned around the inner body 2316, e.g., engaging the ramped surfaces 2318A and 2318B, respectively. The setting tool 2304 further includes a setting sleeve 2320 that is positioned adjacent to the first sleeve 2306 and is configured to entrain the first sleeve 2306 between the ramped surface 2318A and the setting sleeve 2320 prior to activation.

The second sleeve 2308 may be connected to the inner body 2316 via a connection member 2322, such as a shear pin, shear screw, adhesive, or other shearable structure or device. In some embodiments, the second sleeve 2308 may include a tapered first shoulder 2324 that may engage or face the ramped surface 2318B, and may be configured to slide axially and radially on the ramped surface 2318B. Further, the second sleeve 2308 may include a second shoulder 2326 which may be positioned on a radial outside of the second sleeve 2308 and may be configured to engage the second shoulder 2323 of the first sleeve 2306.

Figure 24:
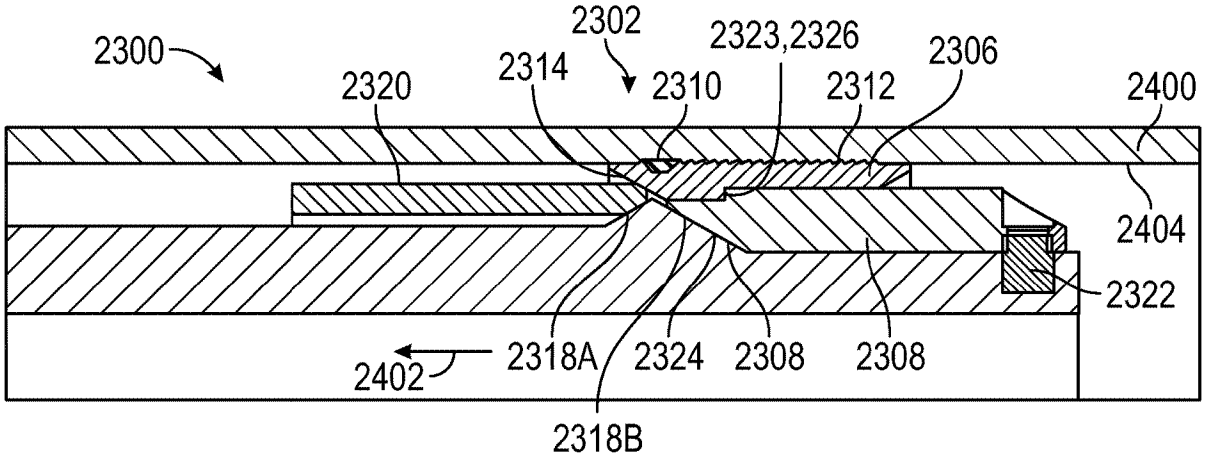
FIG. 24 illustrates a side, cross-sectional view of the downhole tool of FIG. 23, but in a set configuration, according to an embodiment.

FIG. 24 illustrates a sectional view of the tool 2300 in a set configuration and disposed in a surrounding tubular 2400 (e.g., a casing, liner, the wellbore wall, etc.), according to an embodiment. Once the sleeve 2302 is placed within the tubular 2400 at a desired location, the setting tool 2304 may be activated to expand a portion of the sleeve 2302, thereby setting the tool 2300. During activation, the inner body 2316 is pulled in the direction indicated by arrow 2402, while the setting sleeve 2320 pushes on the first sleeve 2306 in the opposite axial direction. Eventually, the inner body 2316 moves axially relative to the first sleeve 2306 (either the inner body 2316 may be moved relative to a stationary reference plane, or the setting sleeve 2320 may move the first sleeve 2306, or both). This causes the first sleeve 2306 of the sleeve 2302 to move up the ramped surface 2318A, thereby expanding (swaging) the first sleeve 2306, including, in some embodiments, the first shoulder 2314 thereof. At the same time, the second sleeve 2308 moves relative to the expandable sleeve 2302, along with the inner body 2316 to which it is connected, such that the second sleeve 2308 is brought to a position that is radially inside of at least a portion of the first sleeve 2306. Eventually, the second shoulder 2323 of the first sleeve 2306 engages the second shoulder 2326 of the second sleeve 2308. In this position, the first shoulder 2314 of the first sleeve 2306 may be generally continuous with the first shoulder 2324 of the second sleeve 2308, e.g., the radially inner-most point of the first shoulder 2314 may be axially aligned with the radially outer-most point of the second shoulder 2326 (within a reasonable tolerance). Accordingly, the first shoulders 2314, 2324 may cooperatively provide a seat profile for engaging an isolation devices, as will be described below.

At this point, the first sleeve 2306 is radially expanded from the first outer diameter to the second larger outer diameter and into engagement with an inner surface 2404 of the tubular 2400. Thus, the first sleeve 2306 resists movement relative to the tubular 2400 because it is gripping the tubular 2400. With the second shoulders 2323, 2326 engaging one another, and the first sleeve 2306 gripping the surrounding tubular, further movement of the setting tool 2304 is resisted by the connection between the second sleeve 2308 and the inner body 2316. As such, the connection member 2322 yields under the force applied by the setting tool 2304, thus allowing the setting tool 2304 to be disconnected from the expandable sleeve 2302, while the first and second sleeves 2306, 2308 may remain in engagement with one another.

When the first sleeve 2306 of the sleeve 2302 engages the tubular 2400, the seal member 2310 forms a seal with the tubular 2400 and the engaging members 2312 may bite into the inner surface 2404 of the tubular 2400. After the sleeve 2302 is engaged with the tubular 2400, the setting tool 2304 may be removed from the tubular 2400.

Figure 25:
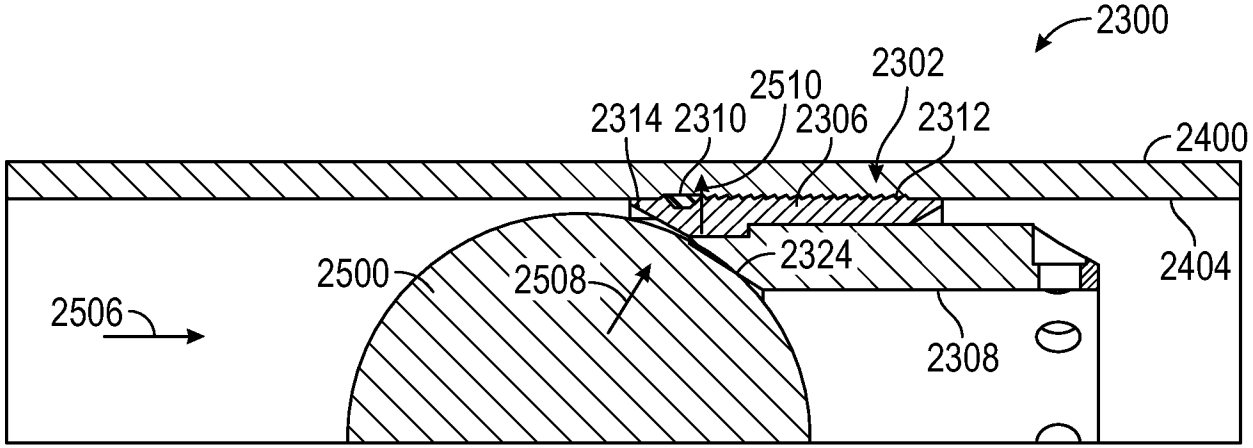
FIG. 25 illustrates a side, cross-sectional view of the downhole tool of FIGS. 23 and 24, engaging an isolation device, according to an embodiment.

FIG. 25 illustrates a sectional view of the tool 2300 in a set configuration in the tubular 2400, with the setting tool 2304 removed and an isolation device 2500 engaging the sleeve 2302, according to an embodiment. After the sleeve 2302 is set in the tubular 2400, the tubular 2400 may be perforated using a perforating gun (not shown). Next, the isolation device 2500, which may be a ball, dart, or any other type of obstructing member, is dropped or pumped into the wellbore and subsequently is received at least partially into the sleeve 2302. For example, either or both of the first shoulders 2314 and 2324 of the first and second sleeves 2306, 2308, respectively, may engage the isolation device 2500, so as to block a through-bore 2502 extending through the sleeve 2302. Since the sleeve 2302 may be sealed with the tubular 2400 as well, frac fluid injected into the wellbore during a fracking operation may be prevented from flowing past the tool 2300 and may be directed through the perforations.

During the fracking operation, the frac fluid may apply a pressure on the isolation device 2500, which may in turn generate a force in the direction indicated by arrow 2504 thereon. As a result, the isolation device 2500 may apply a force, as indicated by arrow 2506, on the sleeve 2302. With the first shoulders 2314, 2324 being wedge shaped, at least some of this axial force 256 may be transferred to a radial force, as indicated by arrow 2510, on the sleeve 2302. This may serve to further expand the sleeve 2302 and thereby enhance the seal by the sealing member 210 and/or the grip of the engaging members 2312.

After the first fracking operation is complete, another sleeve may be run into the tubular 2400 at a location above the first sleeve 2306, and the process is repeated until all the zones in the wellbore are fractured. Each sleeve may be configured to receive the same size isolation device. After the fracking operation is complete, the sleeve may be removed by dissolving the sleeve if the sleeve is made from a dissolvable material. In an alternative embodiment, the sleeve may be removed by deploying a gripping member and attaching the gripping member to the sleeve and pulling the sleeve from the tubular. In another embodiment, the sleeve may be removed using a drill bit.

Figure 26:
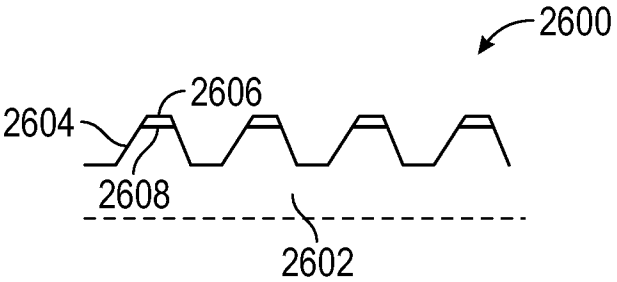
FIG. 26 illustrates a side, schematic view of a slips, according to an embodiment.

FIG. 26 illustrates a view of a portion of a slip 2600, according to an embodiment. The slip 2600 may illustrate an embodiment of the engaging members and a portion of the sleeve body discussed above. Accordingly, as depicted, the slip 2600 includes a body 2602 and a grip member 2604. The grip member 2604 is configured to engage, e.g., embed, in a tubular (not shown). As shown, the grip member 2604 may have a thread shape. A flat surface 2606 of the grip member 2604 may be coated with a grip material 2608, such as tungsten carbide coating or carbide powder. In one embodiment, the body 2602 may be made from a dissolvable material, such as a dissolvable alloy or a dissolvable composite. The dissolvable material may be configured to dissolve over a predetermined amount of time or upon contact with a specific type of fluid.

Figure 27:
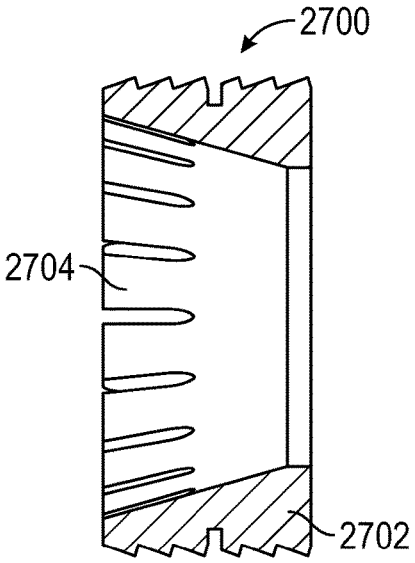
FIG. 27 illustrates a side, cross-sectional view of a slips, according to an embodiment.

FIG. 27 illustrates a cross-sectional view of a slip member 2700, according to an embodiment. The slip member 2700 may provide an embodiment of the engaging members described above. The slip member 2700 includes a body 2702 having a plurality members 2704 which are configured to break up when the slip member 2700 is expanded. The slip member 2700 may include inserts disposed on an outer surface of the body 2702.

The body 2702 of the slip member 2700 may be made from a dissolvable material, e.g., a dissolvable matrix, such as a dissolvable alloy or a dissolvable composite. The dissolvable material may be configured to dissolve over a predetermined amount of time or upon contact with a specific type of fluid. In one embodiment, the dissolvable material may be hardened by mixing cast iron with the dissolvable material. In another embodiment, the dissolvable material matrix may include dissolvable material and ceramic powder (similar to frac sand). During the forming process of the body 2702, the dissolvable material matrix may be ground to a shape. The ceramic powder (or another material harder than 40 Rockwell Hardness—C Scale) is mixed into the dissolvable material matrix, and as a result, the final product will be able to bite into the surrounding tubular since the final product will be harder than the surrounding tubular. In another embodiment, the dissolvable material matrix may include dissolvable material and carbide. In another embodiment, the dissolvable material matrix is a powder metal mixture. For instance, the dissolvable material matrix may include a percentage of hardenable material, such cast iron, steel powder or steel flakes, and a percentage dissolvable material. The hardenable material may be hardened using induction heat treating or other common heat treat methods prior to or after being mixed within the dissolvable material matrix. The percentage of hardenable material may be from 15 percent, or about 20 percent, or about 25 to about 35 percent, about 40 percent or about 50 percent, and the remainder of the power metal mixture being dissolvable material. The powder may include a portion of ceramic powder or sand. In a further embodiment, the body 2702 may be made from dissolvable material matrix which has an outer surface that may be coated with a grip material, such as tungsten carbide coating or carbide powder.

Figure 28A:
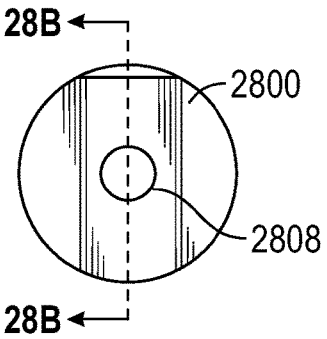
FIGS. 28A, 28B, and 28C illustrate views of an insert for a slips, according to an embodiment.
Figure 28B:
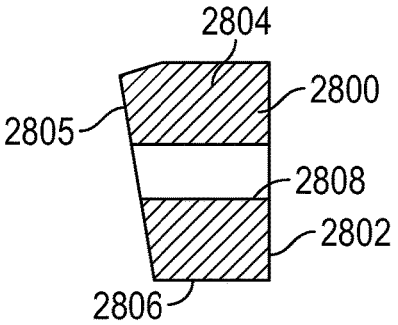
Figure 28C:
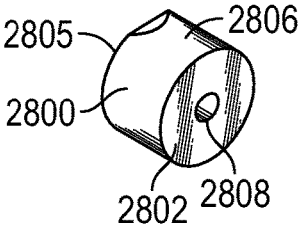

FIG. 28A illustrates a top view of an insert 2800 which may be embedded or otherwise connected to the slip member 2700 (FIG. 27), according to an embodiment. FIG. 28B illustrates a side, cross-sectional view of the insert 2800, according to an embodiment. FIG. 28C illustrates a perspective view of a bottom 2802 of the insert 2800, according to an embodiment.

Referring to FIGS. 28A-C, the insert 2800 may include a body 2804 which may define the bottom 2802 as well as a top 2805 and an annular side 2806 extending therebetween, such that the insert 2800 is generally cylindrical. Other embodiments may have other shapes, however. The top 2805 may be configured to bite into a tubular, e.g., when the slip member 2700 is expanded in use. Accordingly, the top 2805 may be, for example, tapered, as shown, to facilitate the top 2805 cutting into the tubular.

The body 2804 may also define a bore 2808 therein, extending at least partially from top 2805 to bottom 2802. The bore 2808 in the body 2804 may be used to allow the fluid to come in contact more rapidly with a larger surface area of the dissolvable body 2804. The bore 2808 may also be promote the insert 2800 breaking apart at a predetermined time, e.g., when being milled out.

The insert 2800 may be made from a metal (e.g., a carbide, steel, hardened steel, etc.) and/or may be provide as a dissolvable material matrix, such as a dissolvable alloy or a dissolvable composite. The dissolvable material matrix may be configured to dissolve over a predetermined amount of time or upon contact with a specific type of fluid. The insert 2800 may be configured to dissolve at the same time as the body 2804 of the slip member 2700 or at a different time. In one embodiment, the dissolvable material matrix of the body 2804 is a powder metal mixture. For instance, the dissolvable material matrix may include a percentage of hardenable material, such cast iron, and a percentage dissolvable material. In another embodiment, the dissolvable material matrix of the body 460 may include dissolvable material and ceramic powder (similar to frac sand). In another embodiment, the dissolvable material matrix of the body 460 may include dissolvable material and carbide In view of the foregoing, it will be appreciated that embodiments consistent with the tool of any of FIGS. 1-28C may be at least partially dissolvable. For example, the expandable sleeves may be at least partially dissolvable, but in other embodiments, may not be dissolvable. Further, the bodies or swages may be at least partially dissolvable, as may the isolation devices that are seated into the sleeves and/or into the swages/inner bodies. For example, the dissolvable material may be a dissolvable alloy or a dissolvable composite material. In a specific embodiment, the dissolvable material may be a material that includes magnesium. In some embodiments, some components of the tool may be dissolvable, while others may not be dissolvable, in a particular type of fluid. That is, when the dissolvable components dissolve, the non-dissolvable components may remain intact. As an illustrative example, the expandable sleeves may be made at least partially from aluminum, which may remain intact while the magnesium of the dissolvable component(s) may dissolve. Other combinations of dissolvable/non-dissolvable components and materials may be employed, without limitation, as may be found suitable by one of skill in the art. Further, the various components may be partially dissolvable and partially non-dissolvable, without departing from the scope of the present disclosure. Further, in some embodiments, all or a portion of a surface of any dissolvable component may include grooves, or other structures configured to increase a surface area of the surface, so as to increase the rate of dissolution.

Figure 29:
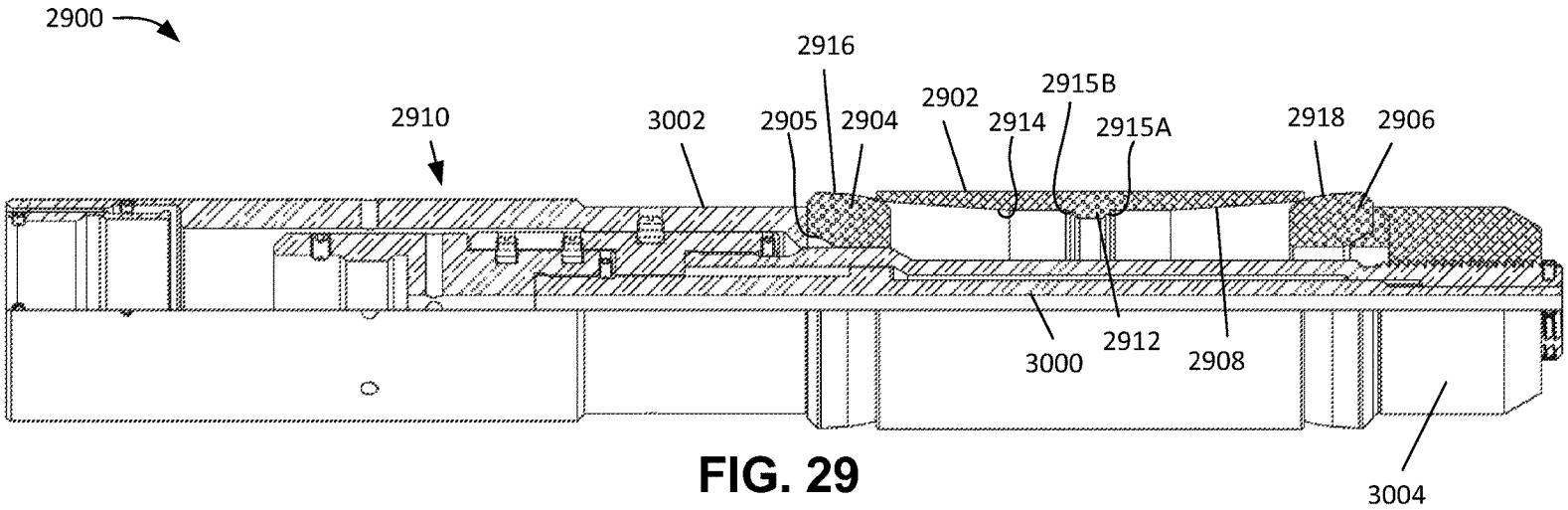
FIGS. 29, 30, and 31 illustrate side, cross-sectional views of another downhole tool in a run-in configuration, a set configuration, and a released configuration, respectively, according to an embodiment.
Figure 30:
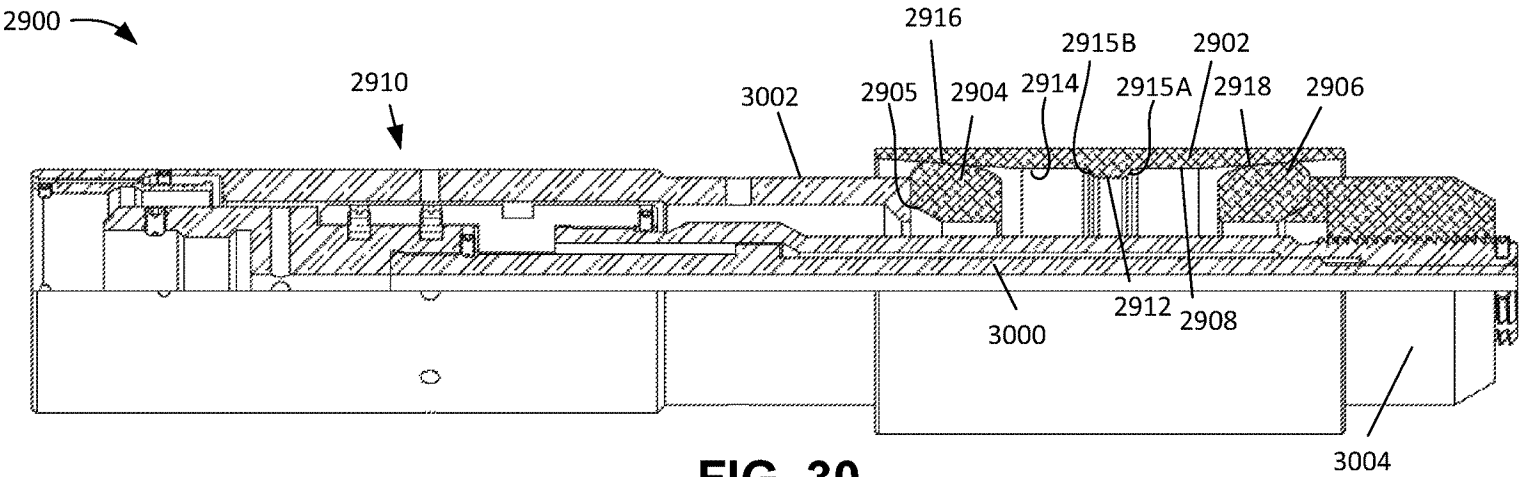
Figure 31:
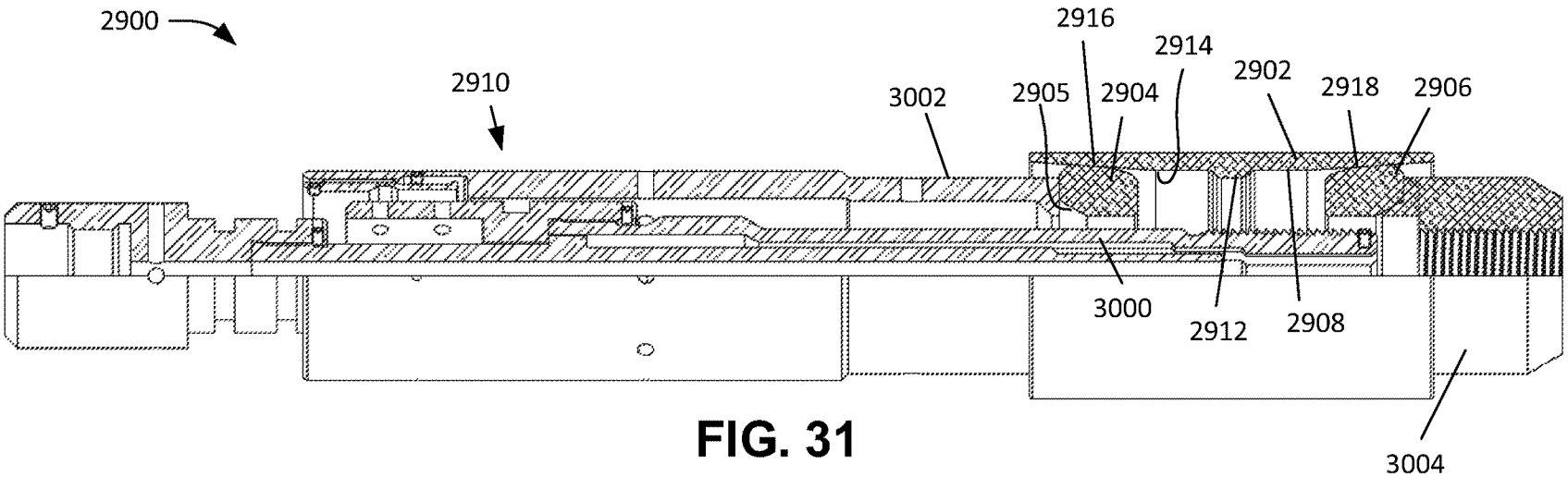

FIGS. 29, 30, and 31 illustrate side, half-sectional views of a downhole tool 2900 in a run-in configuration, a set configuration, and a released configuration, respectively, according to an embodiment. The downhole tool 2900 includes an expandable sleeve 2902, a first swage 2904, and a second swage 2906. The first and second swages 2904, 2906 are positioned at least partially within an axial through-bore 2908 of the expandable sleeve 2902 and are configured to be moved axially toward one another by operating of a setting tool 2910, which may be considered part of the downhole tool 2900 in some embodiments, but, in other embodiments, may be considered part of a tool assembly that includes both the downhole tool 2900 and the setting tool 2910 as separate members.

The first swage 2904 includes an upwardly-facing valve seat (e.g., a ball seat) 2905. Further, the expandable sleeve 2902 includes a shoulder 2912, which extends radially inwards from the bore 2908, axially between the first and second swages 2904, 2906. The shoulder 2912 is configured to provide a stop or end for movement of the first and/or second swages 2904, 2906 within the bore 2908. The shoulder 2912 may be similar in form and/or function to the shoulder 1372 of FIG. 18.

The expandable sleeve 2902 includes an inner surface 2914 that defines the bore 2908. The inner surface 2914 may be tapered, for example, as shown, include two reverse tapers as proceeding in the axial direction. The first and second swages 2904, 2906 define outer surfaces 2916, 2918, respectively, that engage the inner surface 2914 of the expandable sleeve 2902 as the first and second swages 2904, 2906 are moved toward one another within the bore 2908.

Further, the shoulder 2912 may define end faces 2915A, 2915B, which may extend from the inner surface 2914 and be configured to engage and prevent further axial movement of the first and second swages 2904, 2906, respectively. In an embodiment, the end faces 2915A, 2915B may each meet the inner surface 2914 and define an obtuse angle therewith, as shown.

The inner surface 2914 and/or either or both of the outer surfaces 2916, 2918 may include or otherwise have positioned thereon a gripping feature. In an embodiment, the gripping feature may be or include a friction-increasing material (e.g., coating) applied to the inner surface 2914 and/or either or both of the outer surfaces 2916, 2918. Such friction-increasing material may include a grit (e.g., carbide, ceramic, etc.). Further, such friction-increasing material may include a thermal-spray metal. Examples of such friction-increasing materials include one or more of those described in U.S. Pat. Nos. 8,579,024 and 7,487,840, and/or U.S. Patent Publication No. 2015/0060050, which are incorporated by reference above. In other embodiments, the gripping feature may be provided by include teeth, wickers, buttons, designed to bite into (e.g., partially embed in) another material, and/or ratcheting members or other one-way movement devices.

The setting tool 2910 may include an inner body 3000, a setting sleeve 3002, and an optional bearing nut 3004. The inner body 3000 may extend through the setting sleeve 3002, and at least partially through the first and second swages 2904, 2906, and may be releaseably connected to the second swage 2906, such as through a shearable connection with the optional bearing nut 3004. In other embodiments, the body 3000 may be directly connected to the second swage 2906, e.g., by a shearable member such as a shear pin or screw, and the bearing nut 3004 may be omitted. The setting sleeve 3002 may be configured to bear upon the first swage 2902, to apply an axial force thereon towards the second swage 2904. The inner body 3000 (potentially via the bearing nut 3004) may be configured to bear upon the second swage 2904, to apply an axial force thereon towards the first swage 2902.

Accordingly, as shown in FIG. 30, the inner body 3000 may be pulled upwards (toward the left), while the setting sleeve 3002 is pushed downwards (toward the right). This causes the first and second swages 2904, 2906 to move axially toward one another within the expandable sleeve 2902, which in turn causes the expandable sleeve 2902 to deform and expand radially outwards. The distance that the swages 2904, 2906 move toward one another may be dictated by the diameter of the casing (or other oilfield tubular surrounding the tool 2900 downhole) relative to the diameters of the swages 2904, 2906 and the expandable sleeve 2902. In some cases, the swages 2904, 2906 thus may thus not contact the shoulder 2912 in the set configuration. As such, the shoulder 2912 may serve to prevent high pressures from pushing the first swage 2902 axially through the expandable sleeve 2902 (i.e., to the right, and out of the opposite end of the expandable sleeve 2902).

At some point, as shown in FIG. 31, sufficient axial forces may develop between the inner body 3000 and the second swage 2906 that the shearable connection therebetween (e.g., between the bearing nut 3004 and the inner body 3000 or between the inner body 3000 and the second swage 2906) yields, thereby releasing the inner body 3000 from connection/engagement with the second swage 2906. Friction between the first and second swages 2904, 2906 and the expandable sleeve 2902, potentially enhanced by the friction-increasing material (or another gripping feature) discussed above, may maintain the position of the first and second swages 2904, 2906, keeping the expandable sleeve 2902 radially expanded and engaging the surrounding tubular. The inner body 3000 and the setting sleeve 3002 may then be removed. The bearing nut 3004, if provided, may remain coupled to the second swage 2906, or may fall to the sump of the well. Once the inner body 3000 and setting sleeve 3002 are removed, the first swage 2904 is available to receive an obstructing member (e.g., ball) in the seat 2905, so as to obstruct fluid communication (e.g., seal) the bore 2908 of the expandable sleeve 2902.

Figure 32:
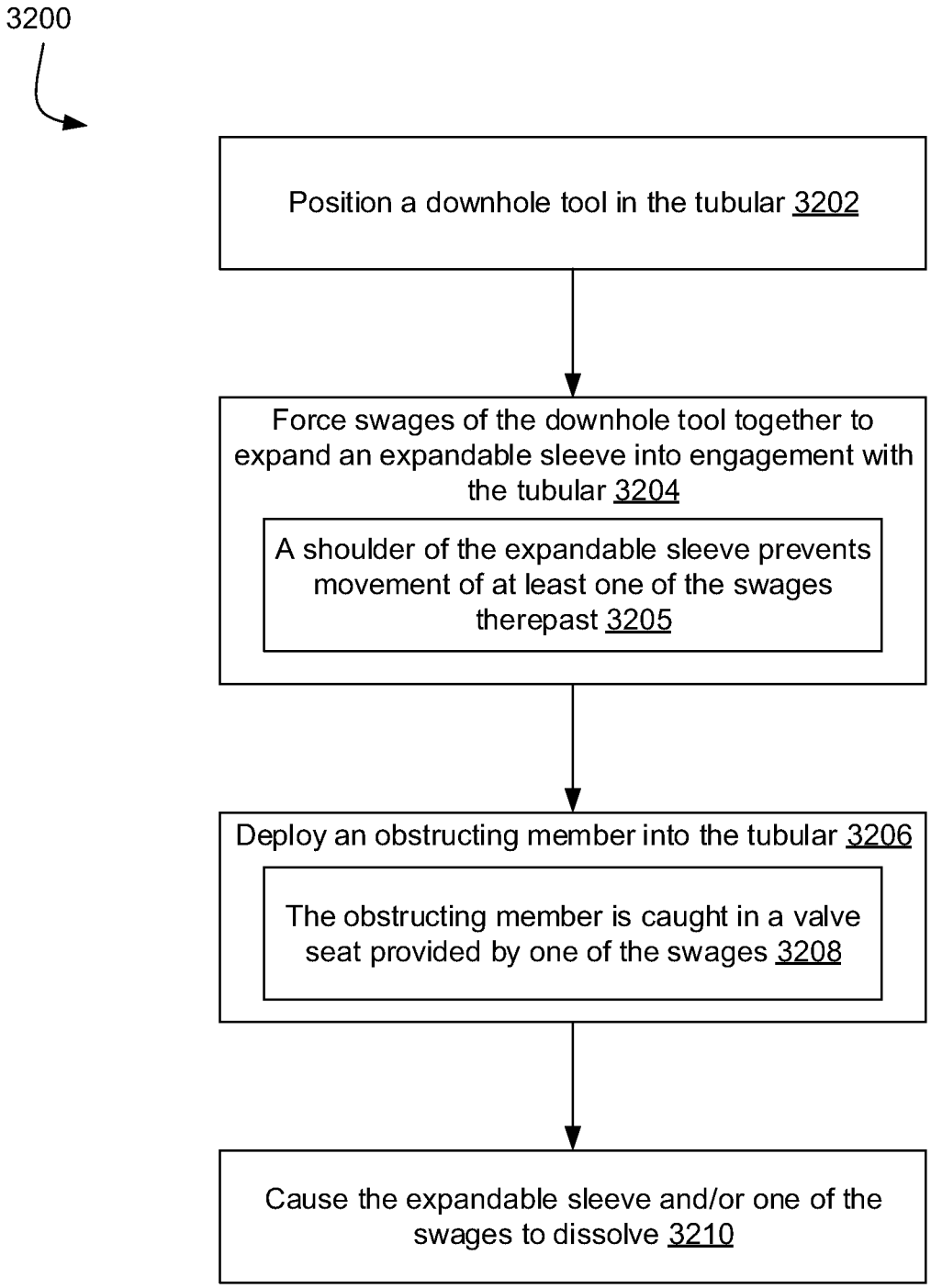
FIG. 32 illustrates a flowchart of a method for plugging an oilfield tubular in a well, according to an embodiment.

FIG. 32 illustrates a flowchart of a method 3200 for plugging an oilfield tubular in a well, according to an embodiment. An example of the method 3200 may be understood with reference to the tool 2900 of FIGS. 29-31; however, it will be appreciated that method 3200 is not limited to any particular structure unless otherwise stated herein.

The method 3200 may include positioning the downhole tool 2900 in an oilfield tubular (e.g., casing, liner, or the wellbore wall), as at 3202. The method 3200 may also include forcing first and second swages 2904, 2906 of the downhole tool 2900 together to expand an expandable sleeve 2902 of the downhole tool 2900 into engagement with the surrounding oilfield tubular, as at 3204. As indicated at 3205, a shoulder 2912 of the expandable sleeve 2902 prevents movement of at least one of the swages 2904, 2906 therepast. It should be noted that the swages 2904, 2906 may or may not contact the shoulder 2912 during the initial expansion of the expandable sleeve 2902; indeed, in at least some embodiments, the expandable sleeve 2902 may be fully expanded into engagement with the surrounding oilfield tubular without the swages 2904, 2906 contacting the shoulder 2912. The shoulder 2912 may, in such case, serve to prevent the first swage 2904 from being forced to slide therepast and potentially downward, through the expandable sleeve 2902, e.g., when the well is plugged by the tool 2900 and pressure is increased above the tool 2900.

The method 3200 may then include deploying an obstructing member into the tubular 3206. The obstructing member (e.g., a ball or dart) may be caught in a valve seat 2905 provided by one of the swages 2904, 2906 (illustrated, by way of example, as provided by the first swage 2904). Once the expandable sleeve 2902 is expanded into engagement with the surrounding tubular and the obstructing member is caught in the valve seat 2905, the tool 2900 blocks (plugs) the tubular.

In some embodiments, the method 3200 may additionally include causing at least a portion of the expandable sleeve 2902, the first swage 2904, the second swage 2906, and/or the obstructing member to dissolve, as at 3210. For example, at least a portion of one of these components may be made at least partially from a material configured to dissolve in the presence of wellbore fluid, e.g., after a predetermined amount of time. Such materials may include various magnesium alloys.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

an expandable sleeve defining a bore extending axially therethrough, and comprising a shoulder that extends inward from the bore, the shoulder comprising a first end face extending from a first portion of the bore, and a second end face extending from a second portion of the bore, wherein the first end face and the first portion of the bore define a first end-face angle where the first portion and the first end face meet, and wherein the second end face and the second portion of the bore define a second end-face angle where the second portion and the second end face meet, the first and second end-face angles each being non-zero;

a first swage positioned at least partially within the bore and comprising a valve seat configured to receive an obstructing member, such that the obstructing member and the first swage substantially prevent fluid communication through the bore when the obstructing member is seated in the valve seat; and a second swage positioned at least partially within the bore, wherein the first and second swages are configured to deform the expandable sleeve radially outwards when the first and second swages are moved toward one another within the expandable sleeve, and wherein the first end face is configured to engage the first swage, or the second end face is configured to engage the second swage, or both, such that the shoulder is configured to prevent at least one of the first or second swages from sliding therepast.

2. The tool of claim 1, wherein:

the first portion of the bore is tapered at a first bore angle, and the second portion of the bore is tapered at a second bore angle, such that an inner diameter of the first portion and an inner diameter of the second portion both decrease as proceeding towards the shoulder;

the first swage is positioned at least partially in the first portion, and the second swage is positioned at least partially in the second portion; and the first and second end-face angles are obtuse angles.

3. The tool of claim 1, wherein the first swage is configured to be uphole of the second swage, and wherein the shoulder is configured to engage the first swage and prevent the first swage from moving downhole through the second portion of the bore.

4. The tool of claim 1, wherein:

the first swage comprises an outer surface;

the expandable sleeve comprises an inner surface at least partially defining the bore, wherein the outer surface is configured to engage the inner surface when the first swage is moved with respect to the expandable sleeve; and the tool further comprises a gripping feature on the outer surface, the inner surface, or both, wherein the gripping feature is configured to resist movement of the first swage relative to the expandable sleeve in at least one axial direction.

5. The tool of claim 4, wherein gripping feature comprises a friction-increasing material applied to the outer surface, the inner surface, or both.

6. The tool of claim 5, wherein the friction-increasing material comprises a grit.

7. The tool of claim 5, wherein the friction-increasing material comprises a thermal-spray metal.

8. The tool of claim 1, wherein the expandable sleeve comprises an outer surface, the outer surface being configured to engage a surrounding tubular when the expandable sleeve is expanded.

9. The tool of claim 8, wherein the outer surface comprises a gripping feature configured to grip the surrounding tubular when the expandable sleeve engages the surrounding tubular.

10. The tool of claim 9, wherein the gripping feature comprises a grit, teeth, wickers, buttons, a thermal-spray metal, or a combination thereof.

11. The tool of claim 1, wherein the expandable sleeve is at least partially formed from a material configured to dissolve in a wellbore.

12. The tool of claim 11, wherein the material comprises magnesium.

13. The tool of claim 1, wherein the first swage is, the second swage is, or both are, formed at least partially from a material configured to dissolve in a wellbore.

14. A tool assembly, comprising:

a downhole tool comprising:

an expandable sleeve defining a bore therethrough, the bore comprising a first portion and a second portion, wherein the expandable sleeve comprises a shoulder that extends inwardly from the bore, the shoulder comprising a first end face extending from the first portion of the bore, and a second end face extending from the second portion of the bore, wherein the first end face and the first portion of the bore define a first end-face angle where the first portion and the first end face meet, and wherein the second end face and the second portion of the bore define a second end-face angle where the second portion and the second end face meet, the first and second end-face angles each being non-zero;

a first swage positioned at least partially within the first portion of the bore and comprising a valve seat configured to receive an obstructing member, such that the obstructing member and the first swage substantially prevent fluid communication through the bore when the obstructing member is seated in the valve seat; and a second swage positioned at least partially within the second portion of the bore; and a setting tool, comprising:

an outer body configured to engage the first swage and apply a force on the first swage directed toward the shoulder; and an inner body extending through the first swage, the expandable sleeve, and the second swage, the inner body being coupled to the second swage and configure to apply a force on the second swage directed toward the shoulder, wherein the first and second swages are configured such that moving the first and second swages toward the shoulder deforms the expandable sleeve radially outwards, and wherein the first end face is configured to engage the first swage, or the second end face is configured to engage the second swage, or both, such that the shoulder is configured to prevent at least one of the first swage or the second swage from being forced therepast.

15. The tool assembly of claim 14, wherein the first swage comprises an outer surface that engages an inner surface of the expandable sleeve, and wherein the outer surface, the inner surface, or both comprise a gripping feature configured to relative movement in at least one direction therebetween.

16. The tool assembly of claim 15, wherein the gripping feature comprises a grit, a thermal spray metal, or a combination thereof.

17. The tool assembly of claim 14, wherein at least one of the expandable sleeve, the first swage, or the second swage is at least partially formed from a material configured to dissolve in a wellbore.

18. A method for plugging an oilfield tubular in a well, comprising:

positioning a downhole tool in the oilfield tubular, the downhole tool comprising an expandable sleeve, a first swage positioned at least partially in the expandable sleeve, and a second swage positioned at least partially in the expandable sleeve;

forcing the first and second swages toward one another within the expandable sleeve, to expand the expandable sleeve into engagement with the oilfield tubular, wherein the expandable sleeve comprises a bore against which the first and second swages slide, and a shoulder that extends inwardly from the bore, wherein the shoulder comprises a first end face extending from a first portion of the bore, and a second end face extending from a second portion of the bore, wherein the first end face and the first portion of the bore define a first end-face angle where the first portion and the first end face meet, and wherein the second end face and the second portion of the bore define a second end-face angle where the second portion and the second end face meet, the first and second end-face angles each being non-zero, the first end face being configured to engage the first swage, or the second end face being configured to engage the second swage, or both such that the shoulder is configured to prevent at least one of the first swage or the second swage from sliding therepast; and deploying an obstructing member into the tubular, wherein the first swage comprises a valve seat that is configured to catch the obstructing member, the expandable sleeve, the first swage, and the obstructing member being configured to block the oilfield tubular when the expandable sleeve is expanded and the obstructing member is seated in the valve seat.

19. The method of claim 18, further comprising causing the expandable sleeve, the first swage, the obstructing member, or a combination thereof to dissolve.

20. The method of claim 18, wherein the expandable sleeve comprises an inner surface defining the bore, and the first swage comprises an outer surface that slides against the inner surface, to expand the expandable sleeve, when the first and second swages are forced together, wherein the outer surface, the inner surface, or both comprise a gripping feature configured to resist relative movement of the expandable sleeve and the first swage in at least one direction.

21. The method of claim 20, wherein the gripping feature comprises a thermal spray metal, a grit, or a combination thereof.

* * * * *